US010000331B2

(12) United States Patent
Dauendorffer et al.

(10) Patent No.: US 10,000,331 B2
(45) Date of Patent: Jun. 19, 2018

(54) BOTTLE CHANGE APPARATUS, SUBSTRATE TREATMENT APPARATUS, BOTTLE CHANGE METHOD, BOTTLE CAP, BOTTLE CAP CHANGE APPARATUS AND BOTTLE CAP CHANGE METHOD

(71) Applicant: Tokyo Electron Limited, Tokyo (JP)

(72) Inventors: Arnaud Alain Jean Dauendorffer, Koshi (JP); Shinobu Miyazaki, Koshi (JP)

(73) Assignee: Tokyo Electron Limited, Tokyo (JP)

( * ) Notice: Subject to any disclaimer, the term of this patent is extended or adjusted under 35 U.S.C. 154(b) by 723 days.

(21) Appl. No.: 14/340,680

(22) Filed: Jul. 25, 2014

(65) Prior Publication Data

US 2015/0078870 A1 Mar. 19, 2015

(30) Foreign Application Priority Data

Aug. 8, 2013 (JP) ..... 2013-164812
Aug. 8, 2013 (JP) ..... 2013-164813

(51) Int. Cl.

| | |
|---|---|
| ***B67D 7/02*** | (2010.01) |
| ***B65D 83/40*** | (2006.01) |
| ***B65D 47/04*** | (2006.01) |
| ***B05C 11/11*** | (2006.01) |
| ***B05C 11/10*** | (2006.01) |
| *B65D 83/32* | (2006.01) |

(52) U.S. Cl.

CPC ..... *B65D 83/40* (2013.01); *B05C 11/101* (2013.01); *B05C 11/11* (2013.01); *B65D 47/04* (2013.01); *B65D 83/32* (2013.01); *B67D 7/0272* (2013.01)

(58) Field of Classification Search

CPC ..... B65D 83/32; B65D 83/40; B65D 47/04; B67D 7/0272; B05C 11/11; B05C 11/101

See application file for complete search history.

(56) References Cited

U.S. PATENT DOCUMENTS 6,098,848 A * 8/2000 Kawashima ..... B67D 1/0831 137/208

FOREIGN PATENT DOCUMENTS

| | | | |
|---|---|---|---|
| JP | H06-236843 | A | 8/1994 |
| JP | 09-020359 | A | 1/1997 |
| JP | 2000-031000 | A | 1/2000 |
| JP | 2003-181364 | A | 7/2003 |
| JP | 2011-233789 | A | 11/2011 |

* cited by examiner

*Primary Examiner* — Dah-Wei D. Yuan
*Assistant Examiner* — Stephen A Kitt
(74) *Attorney, Agent, or Firm* — Posz Law Group, PLC

(57) ABSTRACT

A bottle change apparatus includes a change mechanism that changes a bottle, and the bottle includes a bottle cap. The bottle cap includes: a treatment solution straw part that forms a treatment solution flow passage for supplying a treatment solution in the bottle to an outside of the bottle and extends to an inside of the bottle; and a treatment solution connecting part that is provided at an end portion outside the bottle of the treatment solution straw part. The change mechanism includes: a connection mechanism part including a treatment solution pipe which is connected to the treatment solution connecting part of the bottle and through which the treatment solution supplied from the bottle flows; and a bottle mounting part that transfers the bottle to a connection position where the treatment solution connecting part and the treatment solution pipe are connected together.

8 Claims, 27 Drawing Sheets

(a)

(b)

(a)

(b)

(a)

(b)

(a)

(b)

(a)

(b)

(a)

(b)

(a)

(b)

(a)

(b)

(a)

(b)

BOTTLE CHANGE APPARATUS, SUBSTRATE TREATMENT APPARATUS, BOTTLE CHANGE METHOD, BOTTLE CAP, BOTTLE CAP CHANGE APPARATUS AND BOTTLE CAP CHANGE METHOD

CROSS REFERENCE TO RELATED APPLICATIONS

This application is based upon and claims the benefit of priority of the prior Japanese Patent Application No. 2013-164813, filed in Japan on Aug. 8, 2013, and the prior Japanese Patent Application No. 2013-164812, filed in Japan Aug. 8, 2013, the entire contents of which are incorporated herein by reference.

BACKGROUND OF THE INVENTION

1. Field of the Invention

The present invention relates to a bottle change apparatus, a substrate treatment apparatus including the bottle change apparatus, a bottle change method, a bottle cap, a bottle cap change apparatus, and a bottle cap change method.

2. Description of the Related Art

In a treatment apparatus that treats a substrate, for example, a treatment solution is used when treating the substrate. This treatment solution is supplied from a bottle storing the treatment solution therein to the treatment apparatus. To an opening portion of the bottle, a cap provided with a straw for sucking the treatment solution is attached. An apparatus that supplies the treatment solution from the inside of the bottle to a semiconductor manufacturing apparatus is described, for example, in Japanese Laid-open Patent Publication No. 2000-31000.

In the apparatus described in Japanese Laid-open Patent Publication No. 2000-31000, when the treatment solution in the bottle runs out, the cap provided with a straw is detached from the bottle, and the straw is inserted into a new bottle and the cap is attached to the opening portion of bottle to change the bottle.

However, in the apparatus described in Japanese Laid-open Patent Publication No. 2000-31000, the straw is detached together with the cap when changing the bottle, thus causing the possibility of debris and so on adhering to the straw portion. If the debris adheres to the straw, the debris and so on enter the bottle when changing the bottle.

Further, as described above, the treatment solution to be used when treating the substrate is supplied from the bottle storing the treatment solution therein to the treatment apparatus. When the treatment solution in the bottle runs out, a treatment solution pipe provided at the treatment apparatus is separated from the bottle, and a new bottle and the treatment solution pipe are connected together. In this regard, conventionally, a bottle cap to which the treatment solution pipe is connected is detachably connected to the bottle to supply the treatment solution, and when the bottle becomes empty, the bottle cap is detached from the bottle, and the bottle is changed with a new bottle as described in Japanese Laid-open Patent Publication No. 2011-233789.

In this method, the treatment solution pipe comes into contact with outside air at the bottle change time, so that the debris may adhere thereto. For this problem, in the configuration described in Japanese Laid-open Patent Publication No. H9-20359, the cap attached to the bottle is fitted into a member to which the treatment solution pipe is connected, and the bottle cap is slid (slid in a direction perpendicular to the extending direction of the treatment solution pipe), thereby making a treatment solution flow passage provided in the bottle cap opposed to the treatment solution pipe. However, in the configuration described in Japanese Laid-open Patent Publication No. H9-20359, a gap occurs between the bottle cap and the treatment solution pipe, and it is far from surely connecting them together.

SUMMARY OF THE INVENTION

A first object of the present invention is to inhibit debris and so on from entering a bottle when changing the bottle. Further, a second object of the present invention is to provide a bottle cap that can be surely connected to a treatment solution pipe.

A bottle change apparatus according to a first aspect of the present invention is an apparatus including a change mechanism that changes a bottle storing a treatment solution therein. The bottle changed by the bottle change apparatus includes a bottle cap that seals an opening portion of the bottle. The bottle cap includes: a treatment solution straw part that forms a treatment solution flow passage for supplying the treatment solution in the bottle to an outside of the bottle and extends to an inside of the bottle; and a treatment solution connecting part that is provided at an end portion outside the bottle of the treatment solution straw part. The change mechanism includes: a connection mechanism part including a treatment solution pipe which is connected to the treatment solution connecting part of the bottle and through which the treatment solution supplied from the bottle flows; and a bottle mounting part that transfers the bottle to a connection position where the treatment solution connecting part and the treatment solution pipe are connected together.

In this bottle change apparatus, the connection between the treatment solution connecting part of the bottle connected to the treatment solution pipe and the treatment solution pipe is released while the bottle cap is kept attached to the opening portion of the bottle, and the treatment solution pipe and the treatment solution connecting part of another bottle are connected together. This makes it possible to change the bottle without exposing the treatment solution straw part to the outside, so that debris and so on never adhere to the treatment solution straw part. Accordingly, it is possible to inhibit debris and so on from entering the bottle when changing the bottle.

A bottle change apparatus according to a second aspect of the present invention is an apparatus including a change mechanism that changes a bottle storing a treatment solution therein. The bottle changed by the bottle change apparatus includes a bottle cap that seals an opening portion of the bottle. The bottle cap includes: a treatment solution straw part that forms a treatment solution flow passage for supplying the treatment solution in the bottle to an outside of the bottle and extends to an inside of the bottle; and a treatment solution connecting part that is provided at an end portion outside the bottle of the treatment solution straw part. The change mechanism includes: a connection mechanism part including a treatment solution pipe which is connected to the treatment solution connecting part of the bottle and through which the treatment solution supplied from the bottle flows; a bottle mounting part that mounts the bottle at a connection position where the treatment solution connecting part and the treatment solution pipe are connected together; and a guide part that positions the bottle so that the treatment solution connecting part of the bottle and the treatment solution pipe are connected together at the bottle mounting part.

In this bottle change apparatus, the connection between the treatment solution connecting part of the bottle connected to the treatment solution pipe and the treatment solution pipe is released while the bottle cap is kept attached to the opening portion of the bottle, and the treatment solution pipe and the treatment solution connecting part of another bottle are connected together. This makes it possible to change the bottle without exposing the treatment solution straw part to the outside, so that debris and so on never adhere to the treatment solution straw part. Accordingly, it is possible to inhibit debris and so on from entering the bottle when changing the bottle. Further, since the guide part that positions the bottle is provided, it is possible to surely connect the treatment solution connecting part and the treatment solution pipe together.

A substrate treatment apparatus according to a third aspect of the present invention includes the above-described bottle change apparatus and a substrate treatment unit that treats a substrate using the treatment solution supplied from a bottle which has been changed by the bottle change apparatus. In this substrate treatment apparatus, the bottle storing the treatment solution therein to be used in the substrate treatment unit can be changed by the bottle change apparatus.

A bottle change method according to a fourth aspect of the present invention is a method of changing a bottle storing a treatment solution therein. The bottle includes a bottle cap that seals an opening portion of the bottle. The bottle cap includes: a treatment solution straw part that forms a treatment solution flow passage for supplying the treatment solution in the bottle to an outside of the bottle and extends to an inside of the bottle; and a treatment solution connecting part that is provided at an end portion outside the bottle of the treatment solution straw part, and connected to a treatment solution pipe through which the treatment solution supplied from the bottle flows. In the case of changing the bottle, connection between the treatment solution connecting part of the bottle connected to the treatment solution pipe and the treatment solution pipe is released, and the treatment solution pipe and the treatment solution connecting part of another bottle are connected together.

In this bottle change method, the connection between the treatment solution connecting part of the bottle connected to the treatment solution pipe and the treatment solution pipe is released while the bottle cap is kept attached to the opening portion of the bottle, and the treatment solution pipe and the treatment solution connecting part of another bottle are connected together. This makes it possible to change the bottle without exposing the treatment solution straw part to the outside, so that debris and so on never adhere to the treatment solution straw part. Accordingly, it is possible to inhibit debris and so on from entering the bottle when changing the bottle.

According to the first, second and fourth aspects of the present invention, it is possible to inhibit debris and so on from entering the bottle when changing the bottle. Further, according to the third aspect of the present invention, it is possible to provide a substrate treatment apparatus including the bottle change apparatus according to the first and second aspects.

A bottle cap according to an aspect of the present invention is for sealing an opening portion of a bottle storing a treatment solution therein, including: a treatment solution straw part and a treatment solution connecting part. The treatment solution straw part forms a treatment solution flow passage for supplying the treatment solution in the bottle to an outside of the bottle and extends to an inside of the bottle. The treatment solution connecting part is provided at an end portion outside the bottle of the treatment solution straw part, and connected to a treatment solution pipe through which the treatment solution supplied from the bottle flows. The treatment solution connecting part is connected to the treatment solution pipe by being relatively brought close in distance to the treatment solution pipe along an extending direction of the treatment solution flow passage at the end portion outside the bottle of the treatment solution straw part and thereby relatively pressed against the treatment solution pipe.

In this bottle cap, the treatment solution connecting part and the treatment solution pipe are connected together by relatively bringing the treatment solution connecting part and the treatment solution pipe close to each other in distance along an extending direction of the treatment solution flow passage at the end portion outside the bottle of the treatment solution straw part and thereby relatively pressing the treatment solution connecting part and the treatment solution pipe against each other. As described above, the treatment solution connecting part is connected to the treatment solution pipe by being relatively pressed against the treatment solution pipe, so that the treatment solution connecting part provided in the bottle cap and the treatment solution pipe can be surely connected together.

A bottle cap change apparatus according to another aspect of the present invention changes a bottle cap, the bottle cap including a treatment solution straw part that forms a treatment solution flow passage for supplying a treatment solution in a bottle to an outside of the bottle and extends to an inside of the bottle, and a treatment solution connecting part that is provided at an end portion outside the bottle of the treatment solution straw part and connected to a treatment solution pipe through which the treatment solution supplied from the bottle flows. To this end, the bottle cap change apparatus includes: a first cap change mechanism that detaches the bottle cap from the bottle and attaches the bottle cap to another bottle from which a cap for transfer time has been detached; a second cap change mechanism that detaches the cap for transfer time from the bottle; and a straw cleaning unit that cleans the treatment solution straw part. In this bottle cap change apparatus, the first cap change mechanism and the second cap change mechanism can change the bottle cap, facilitating the change work. Further, the bottle cap change apparatus includes the straw cleaning unit and therefore can clean out debris adhering to the treatment solution straw part and thereby inhibit debris from entering the bottle when changing the bottle cap.

A bottle cap change method according to another aspect of the present invention is a method of changing a bottle cap, the bottle cap including a treatment solution straw part that forms a treatment solution flow passage for supplying a treatment solution in a bottle to an outside of the bottle and extends to an inside of the bottle, and a treatment solution connecting part that is provided at an end portion outside the bottle of the treatment solution straw part and connected to a treatment solution pipe through which the treatment solution supplied from the bottle flows. In this bottle cap change method, the bottle cap is detached from the bottle, then the treatment solution straw part of the bottle cap is cleaned, and thereafter the bottle cap is attached to another bottle from which a cap for transfer time has been detached. Thus, it is possible to detach the bottle cap including the treatment solution straw part and the treatment solution connecting part from the bottle, clean the treatment solution straw part, and thereafter attach the bottle cap to another bottle. Further, cleaning the treatment solution straw part can inhibit debris from entering the bottle when changing the bottle cap.

With the bottle cap according to the one aspect of the present invention, it is possible to surely connect the bottle cap to the treatment solution pipe. With the bottle cap change apparatus according to the another aspect of the present invention and the bottle cap change method according to the still another aspect, it becomes possible to preferably change the bottle cap according to the one aspect of the present invention.

Figure 4:
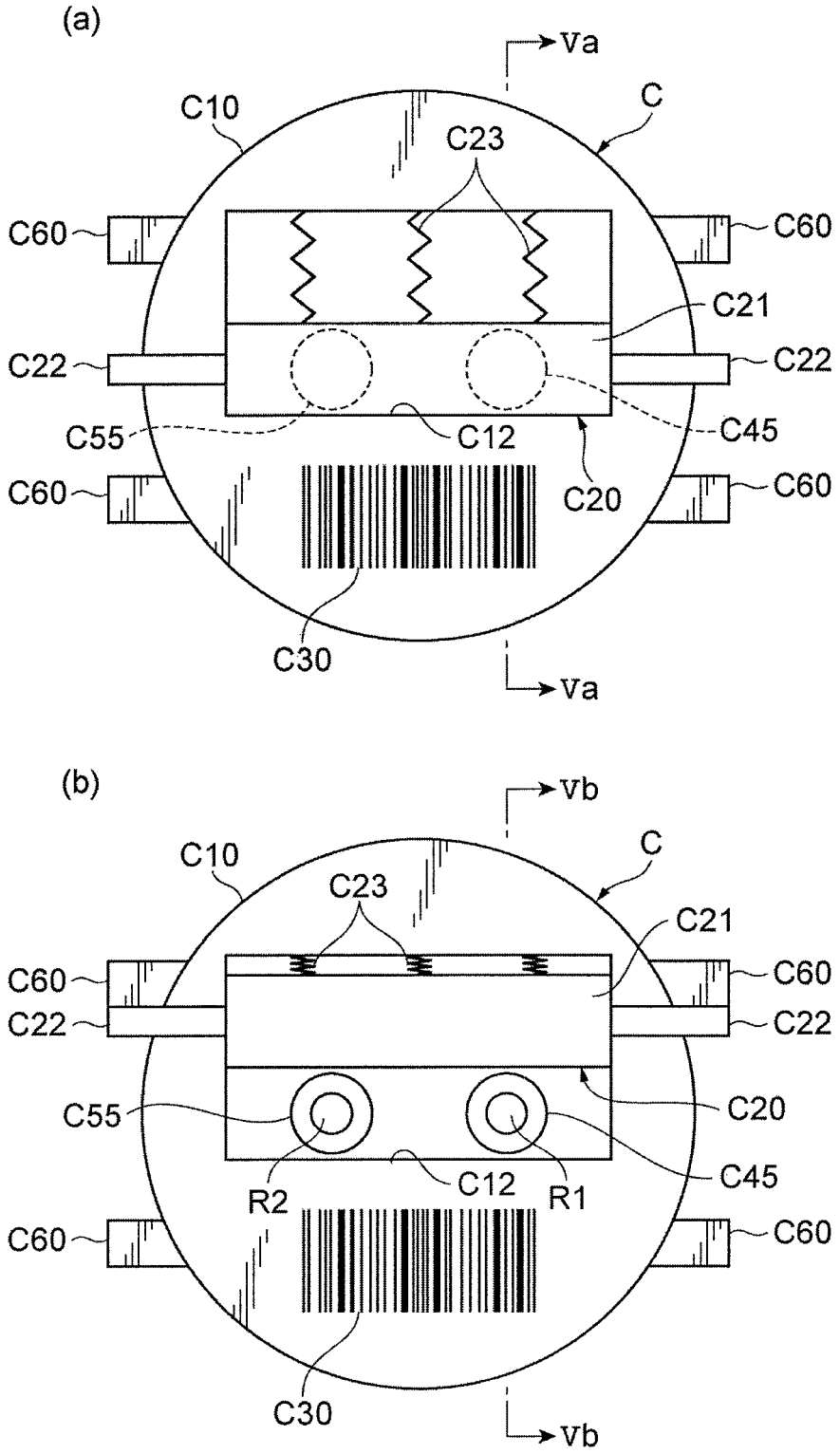
FIG. 4 is a cross-sectional view illustrating opening/closing states of a cover attached to a cap, (a) of FIG. 4 being a view illustrating the state that the cover is closed and (b) of FIG. 4 being a view illustrating the state the cover is opened.
Figure 5:
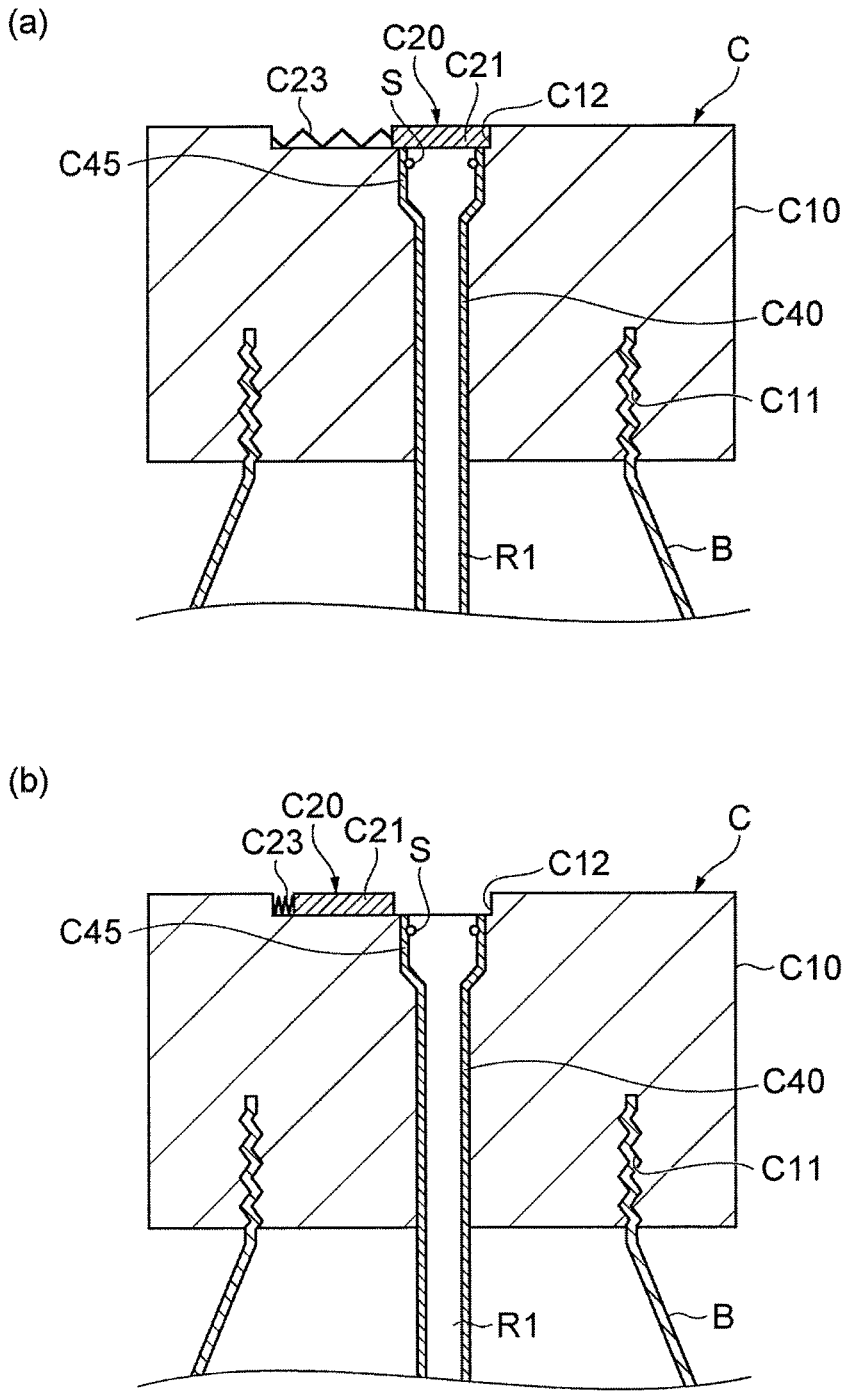
Figure 6:
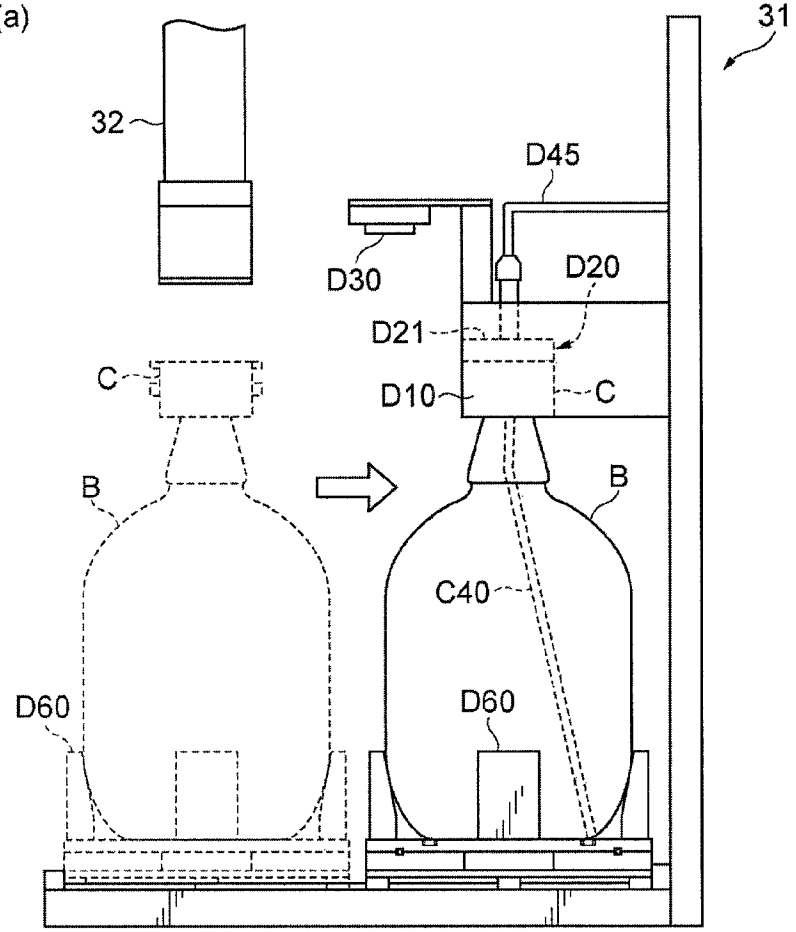
Figure 6:
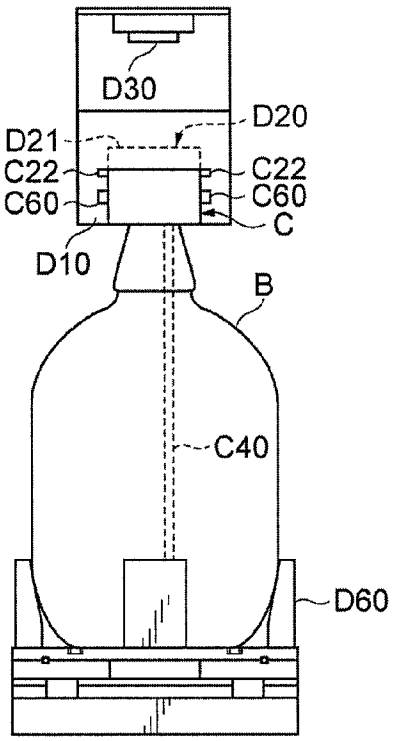
Figure 7:
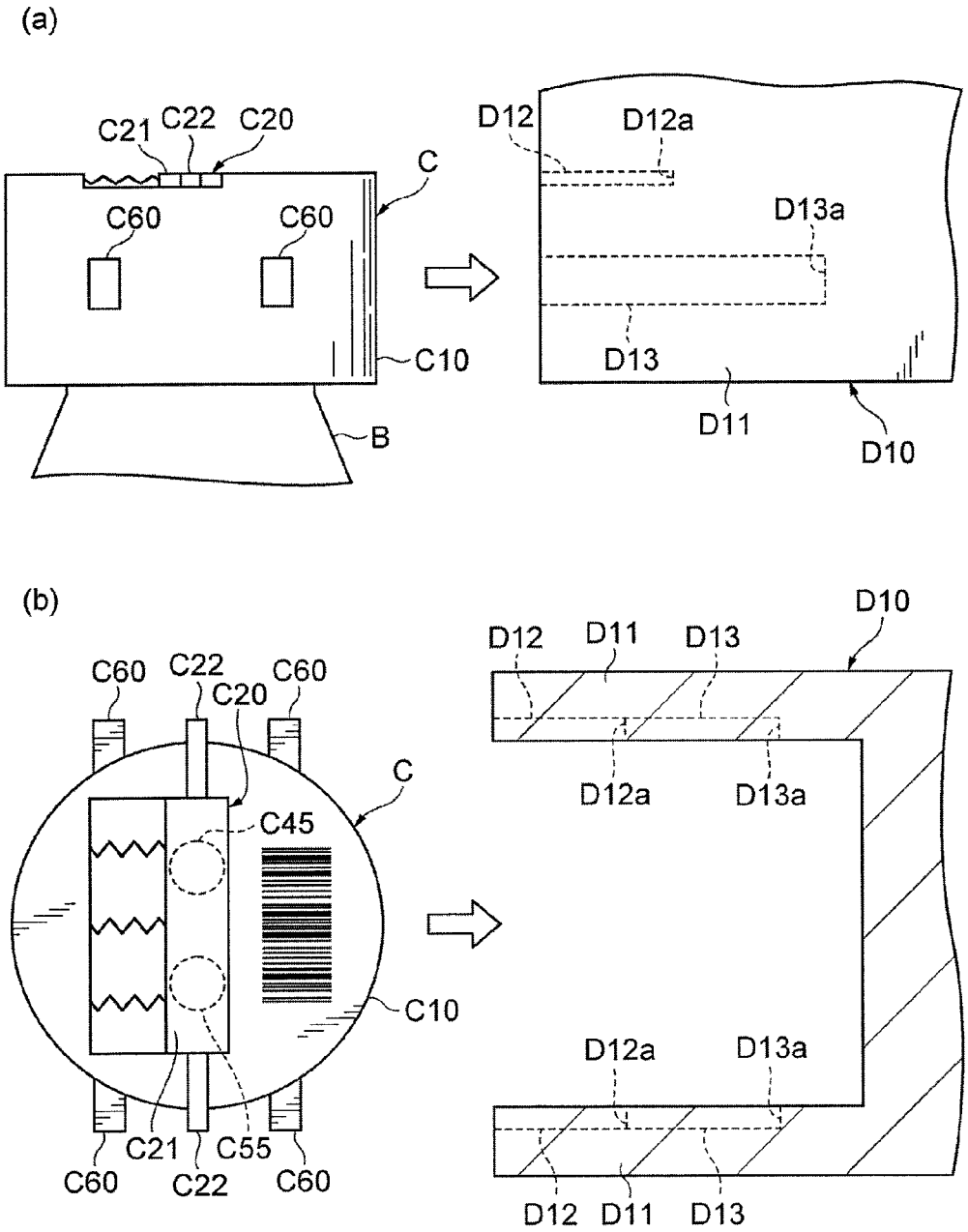
Figure 8:
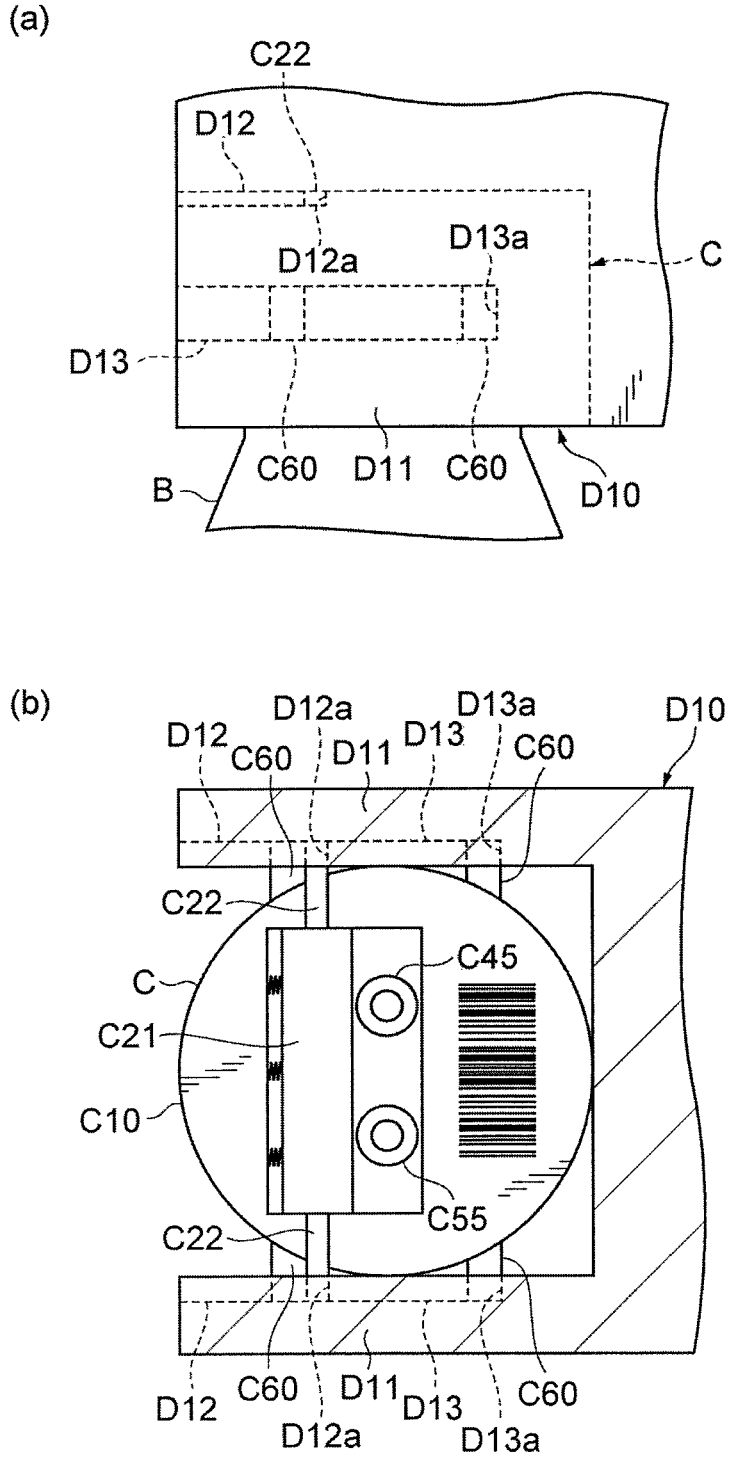
Figure 9:
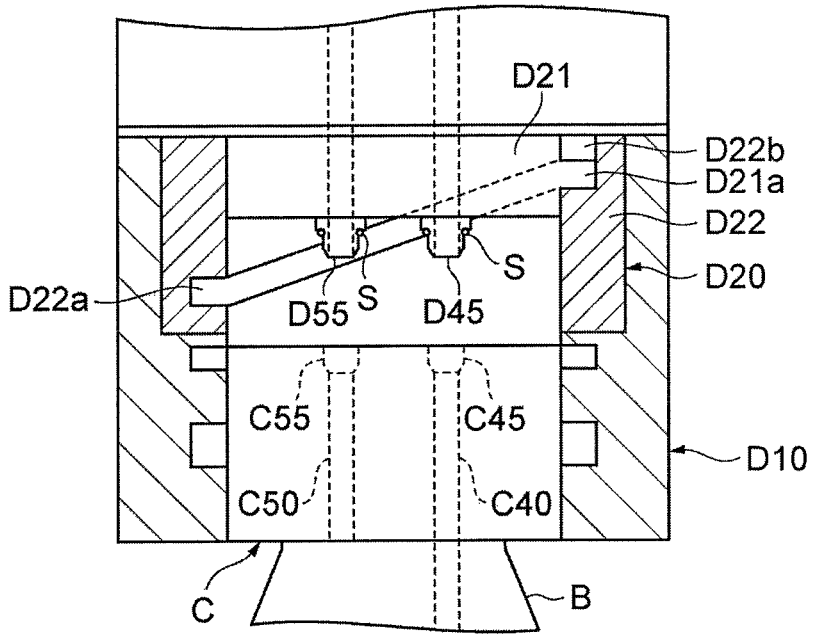
Figure 9:
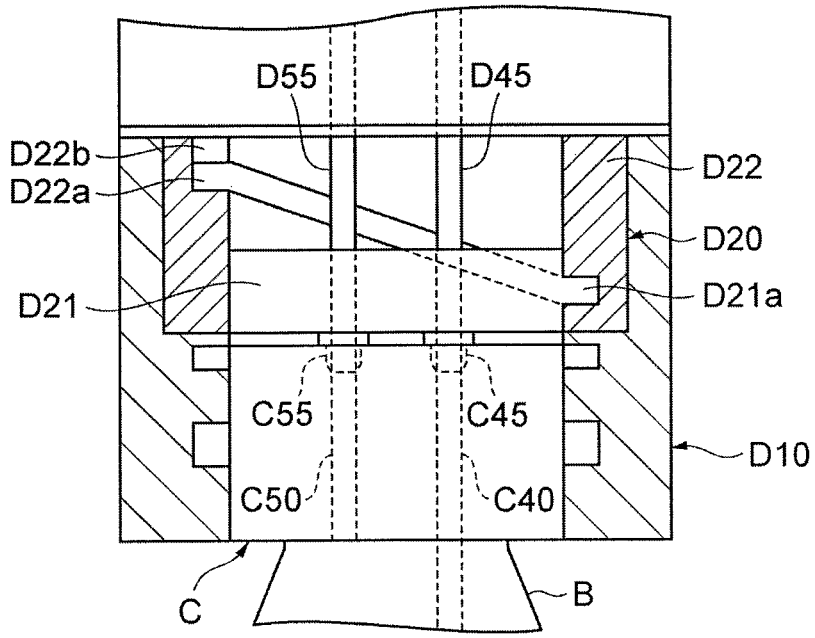
Figure 10:
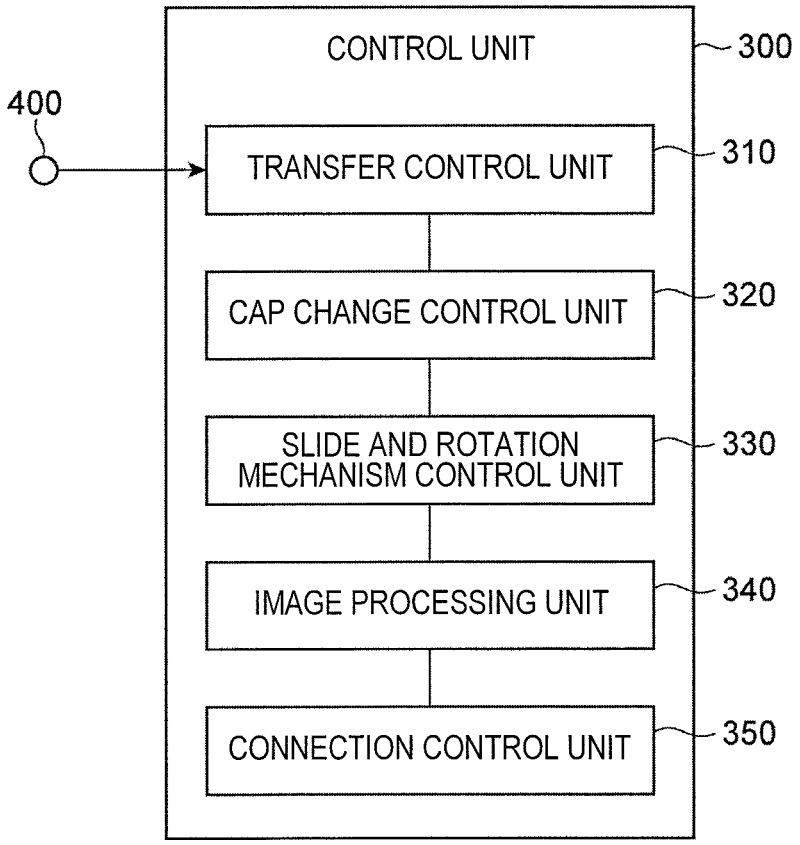
Figure 11:
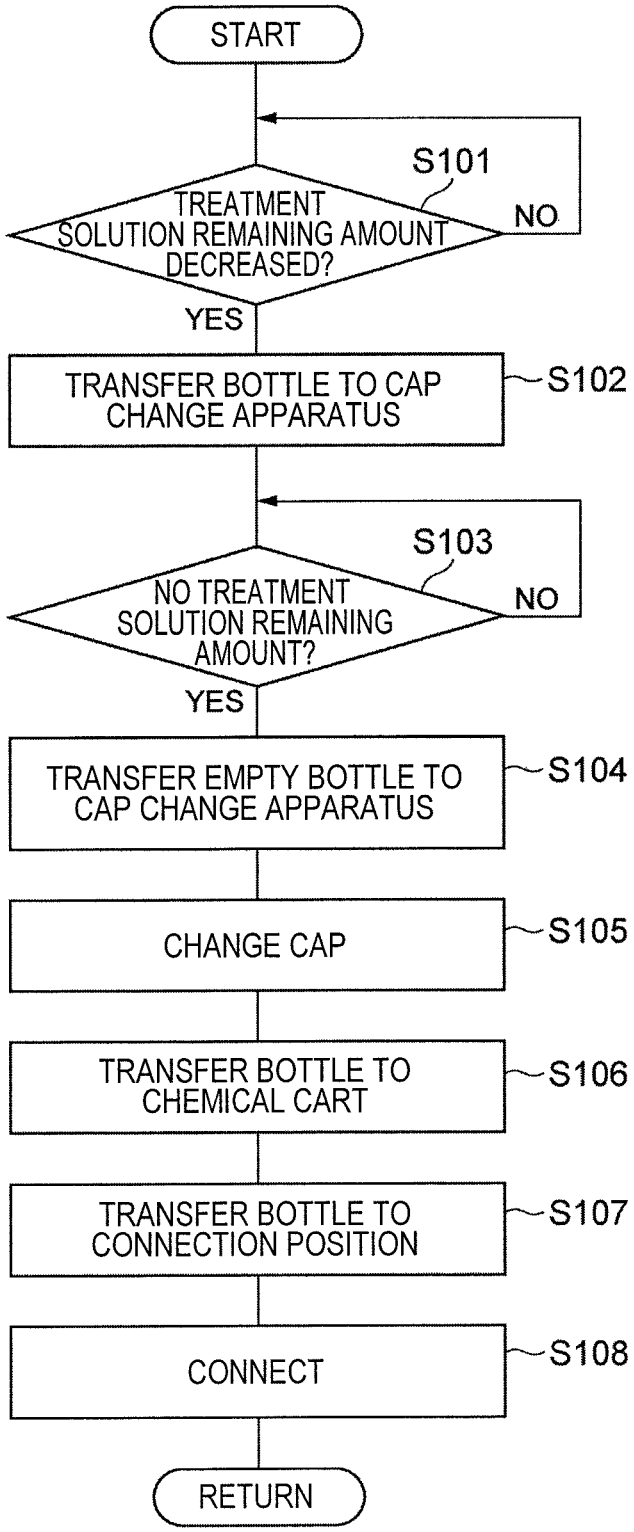
Figure 12:
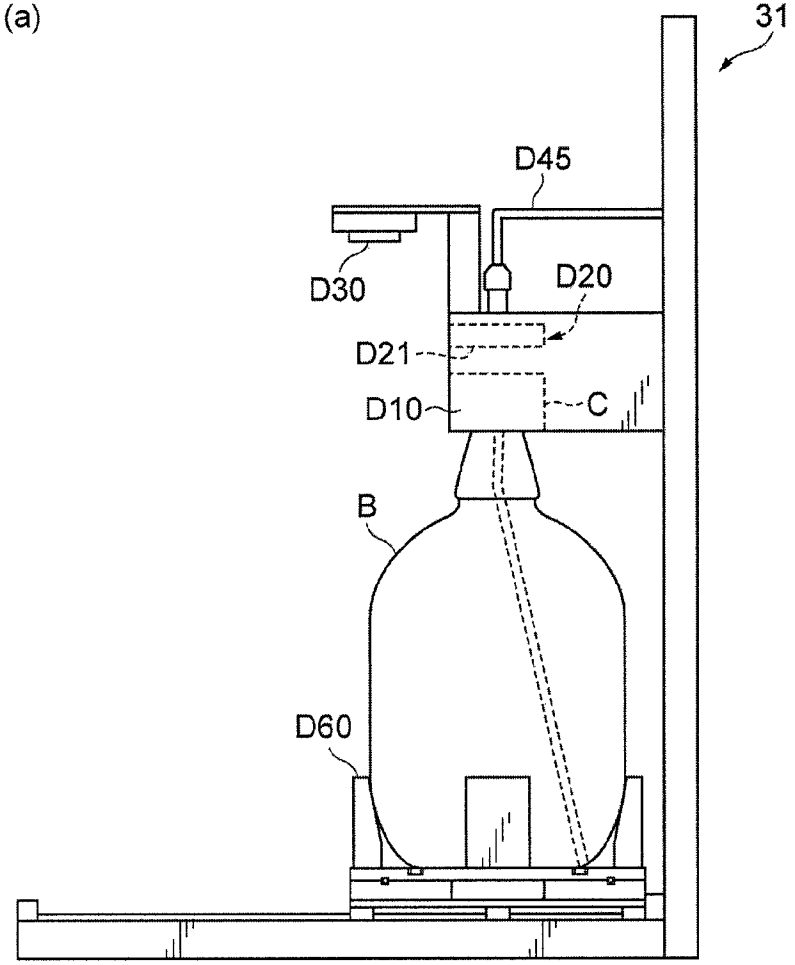
Figure 12:
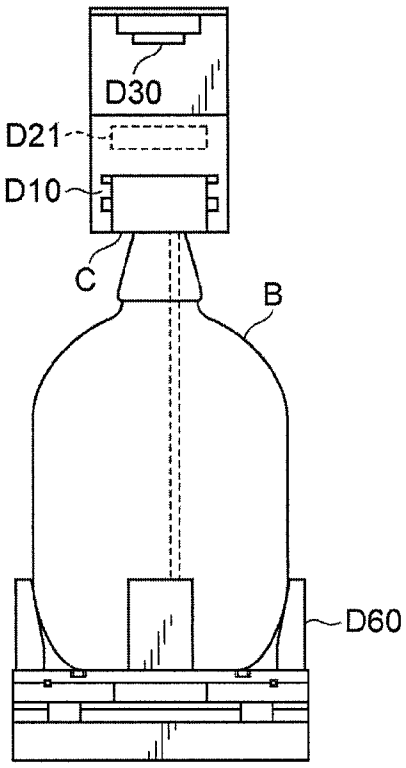
Figure 13:
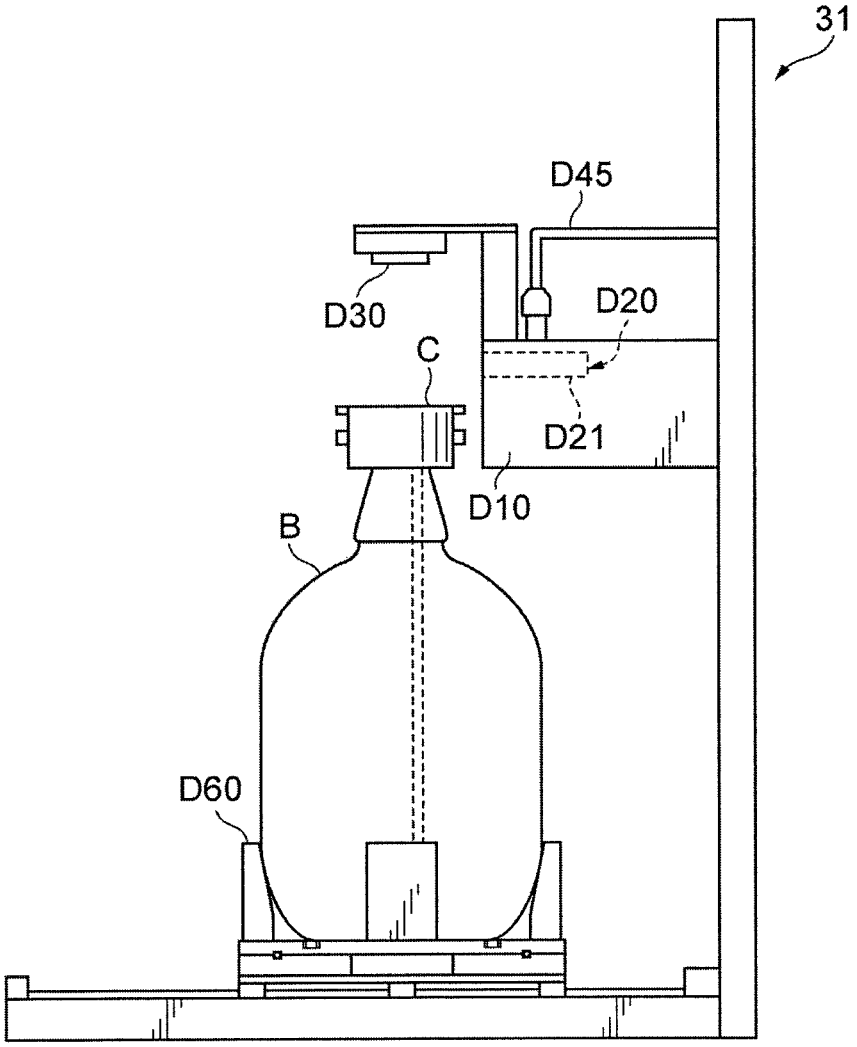
Figure 14:
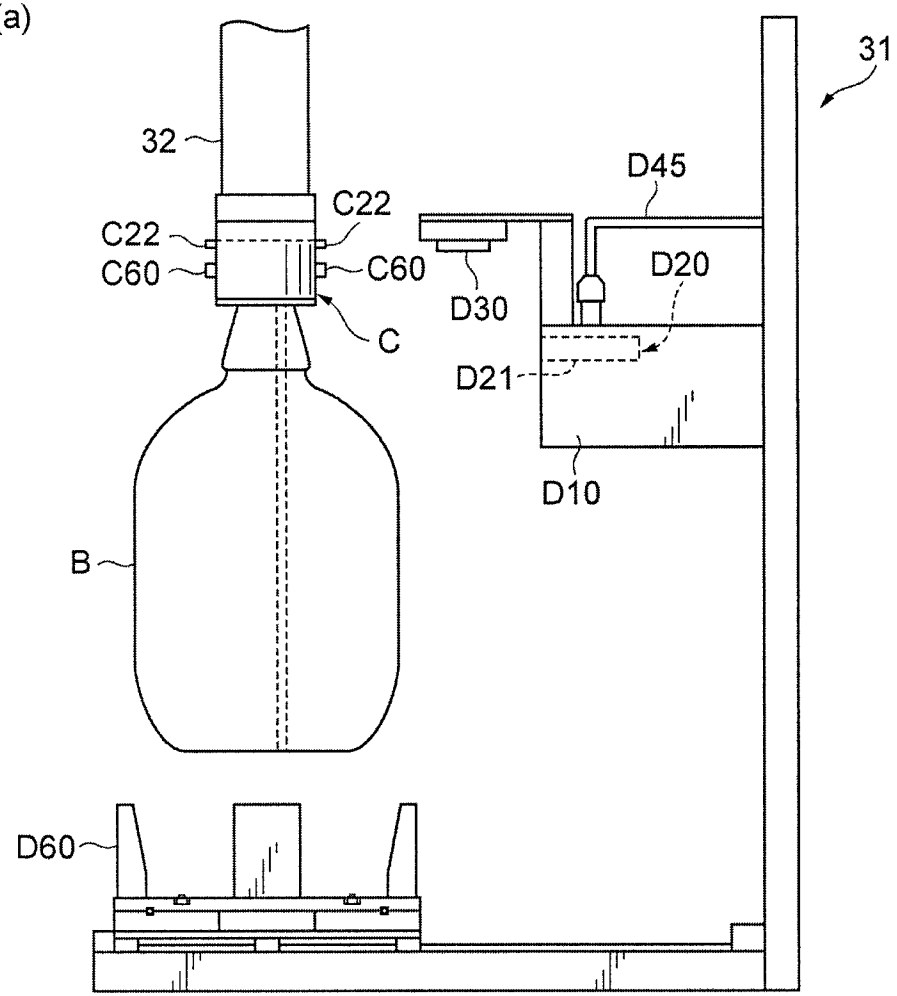
Figure 14:
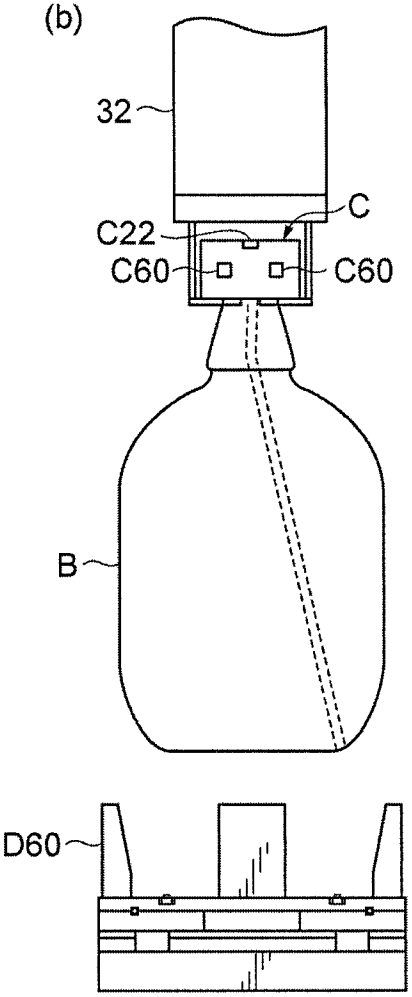
Figure 15:
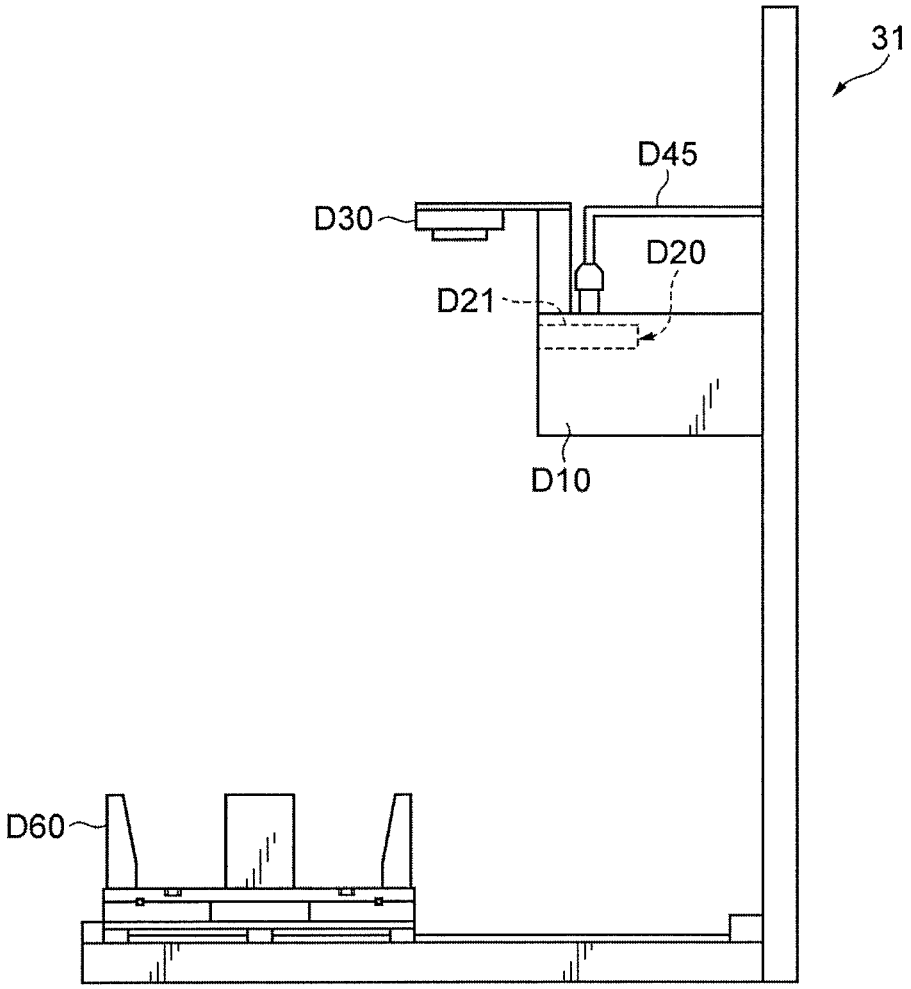
Figure 16:
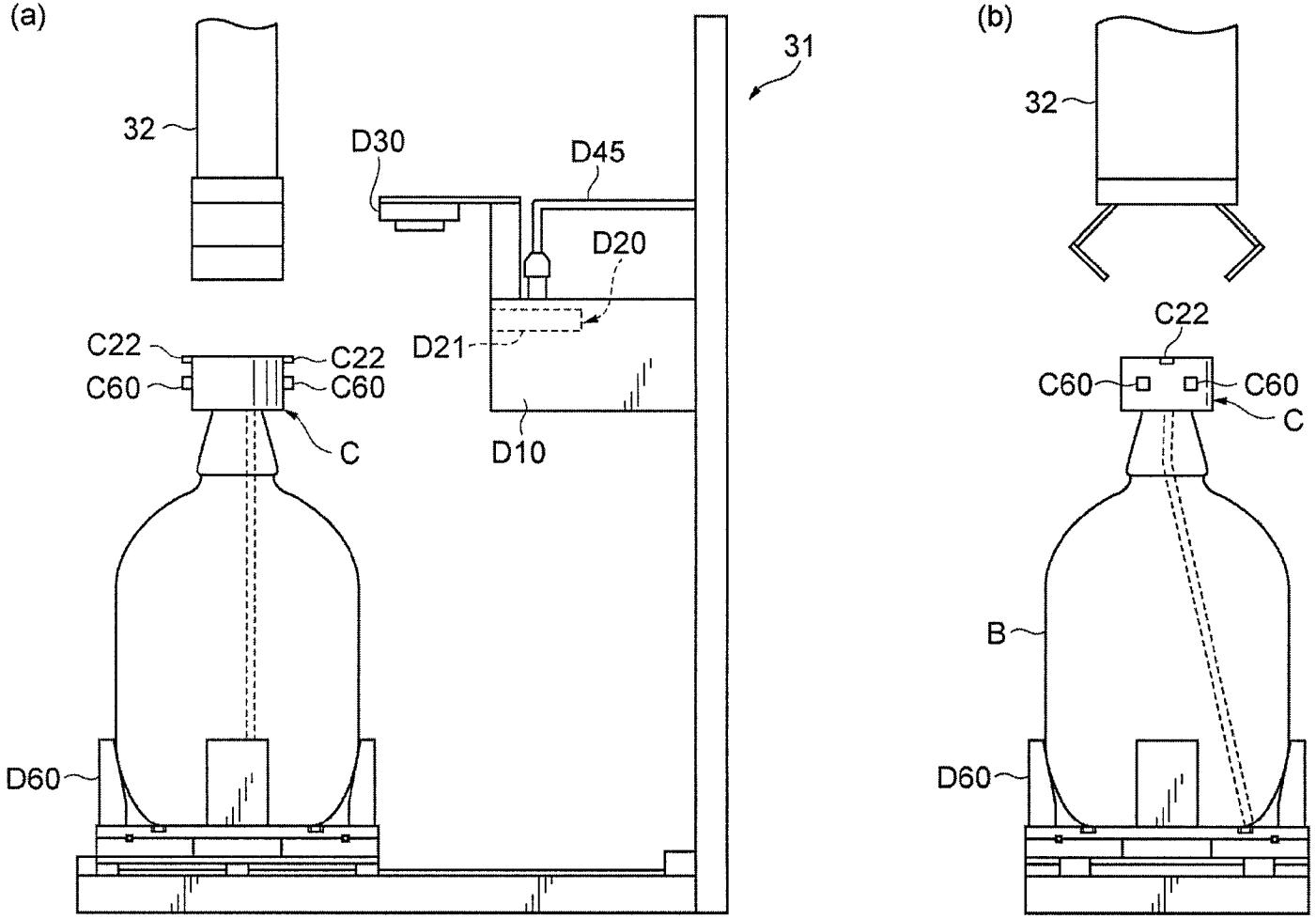
Figure 17:
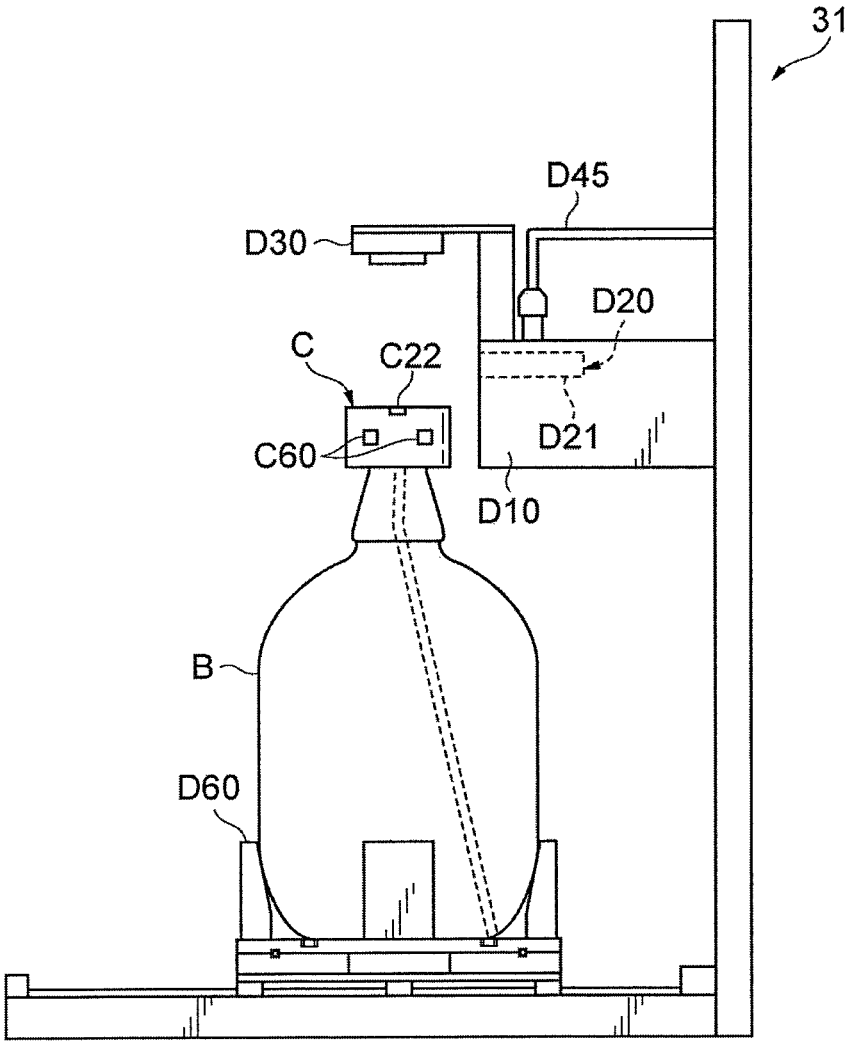
Figure 18:
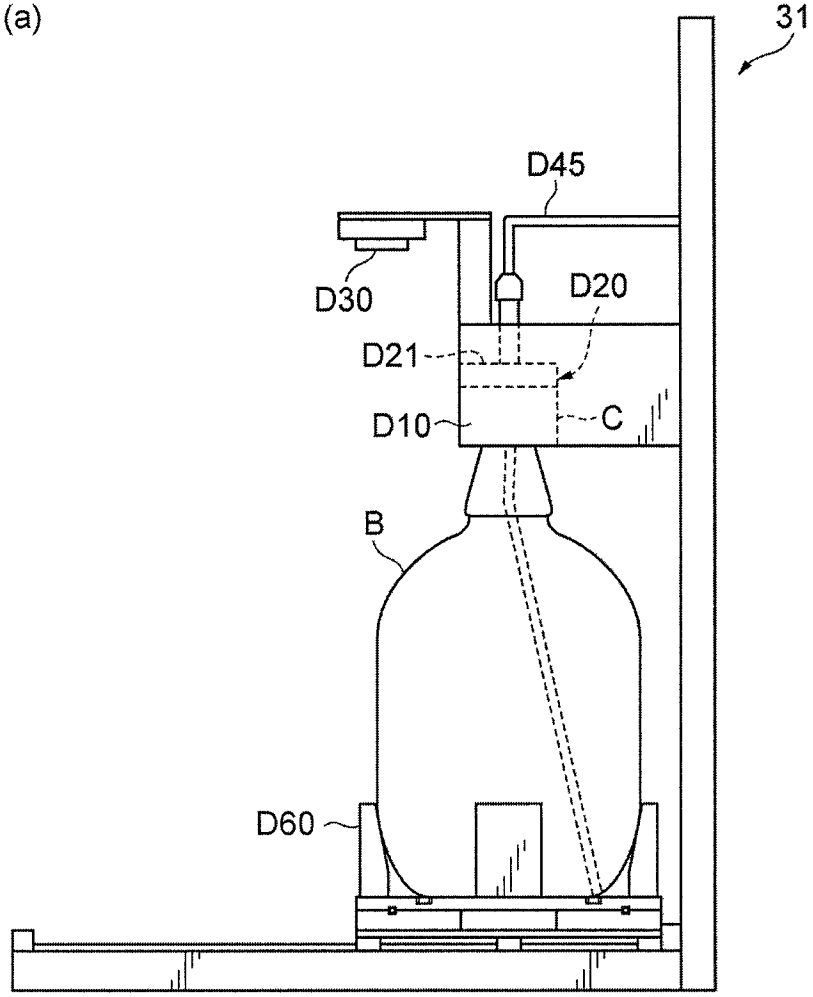
Figure 18:
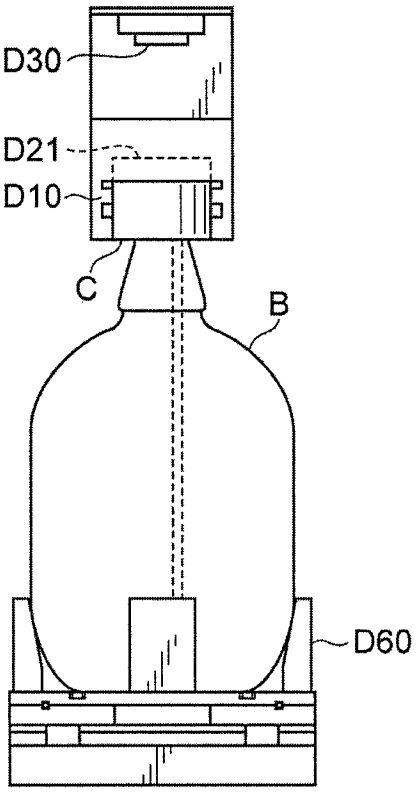
Figure 19:
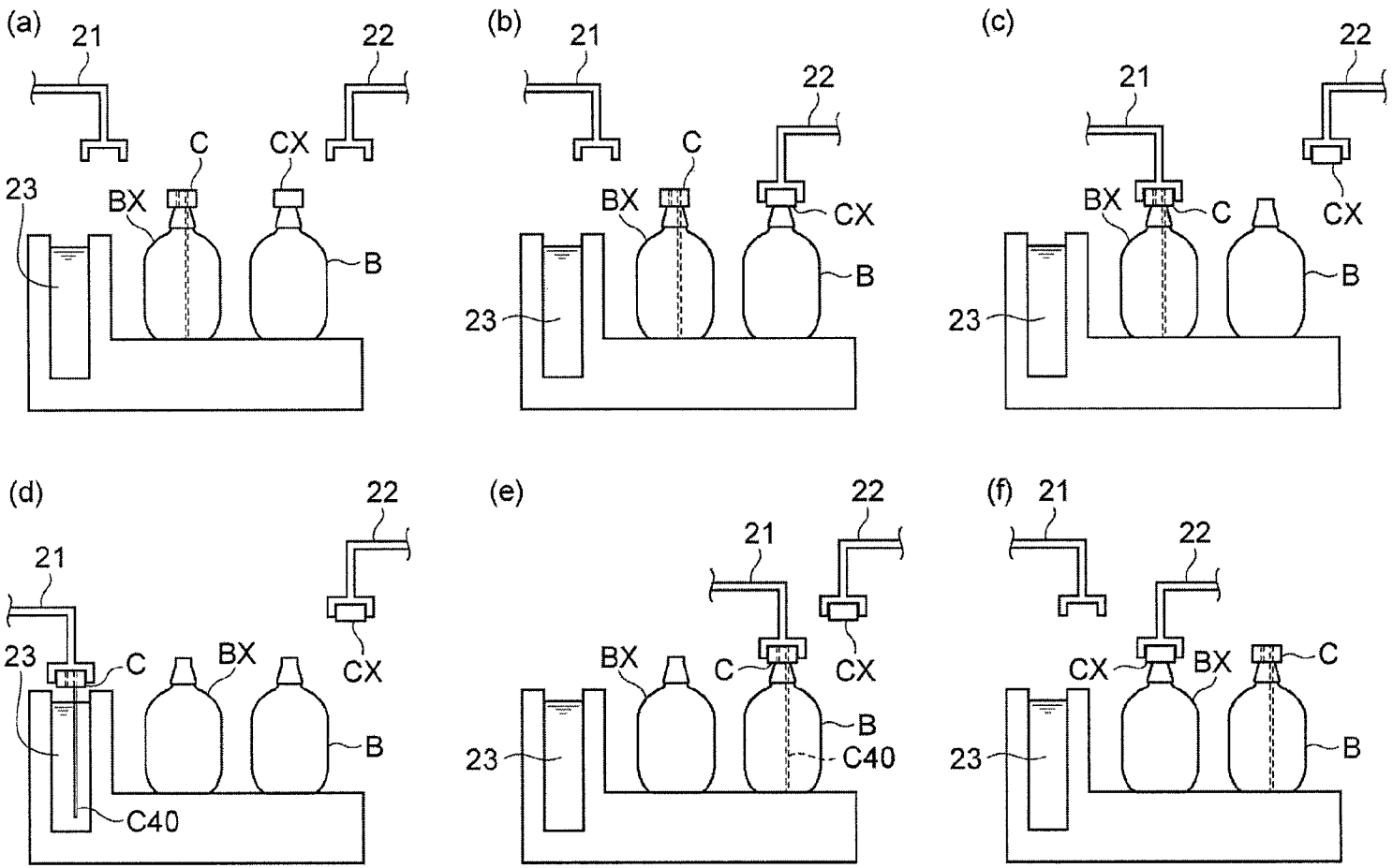
Figure 20:
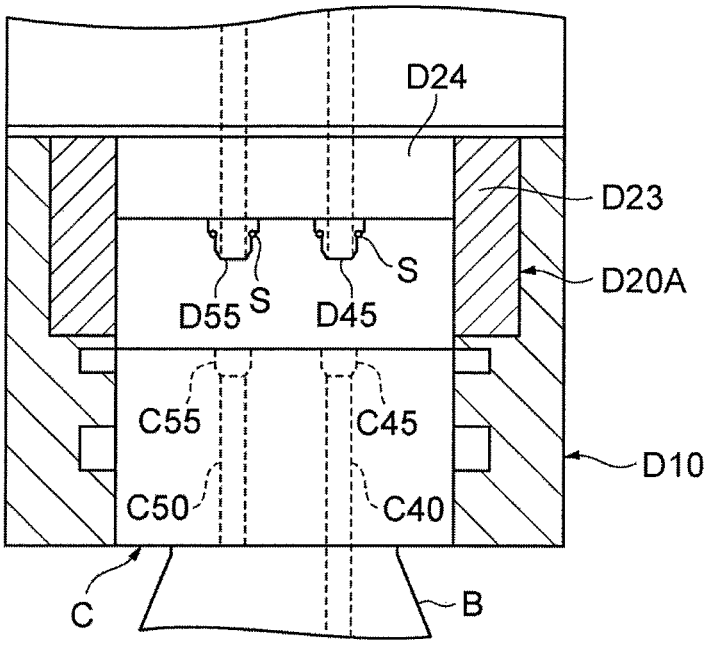
Figure 20:
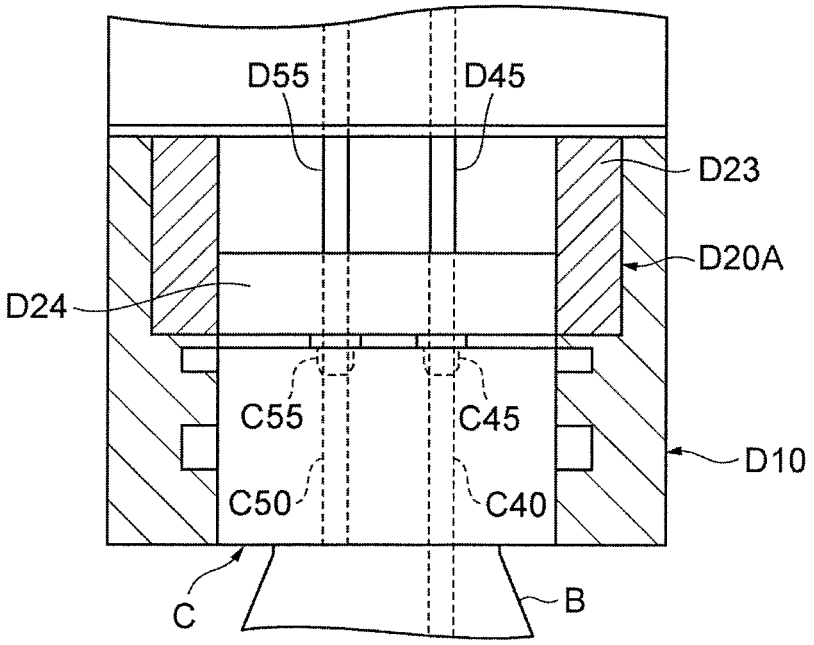
Figure 21:
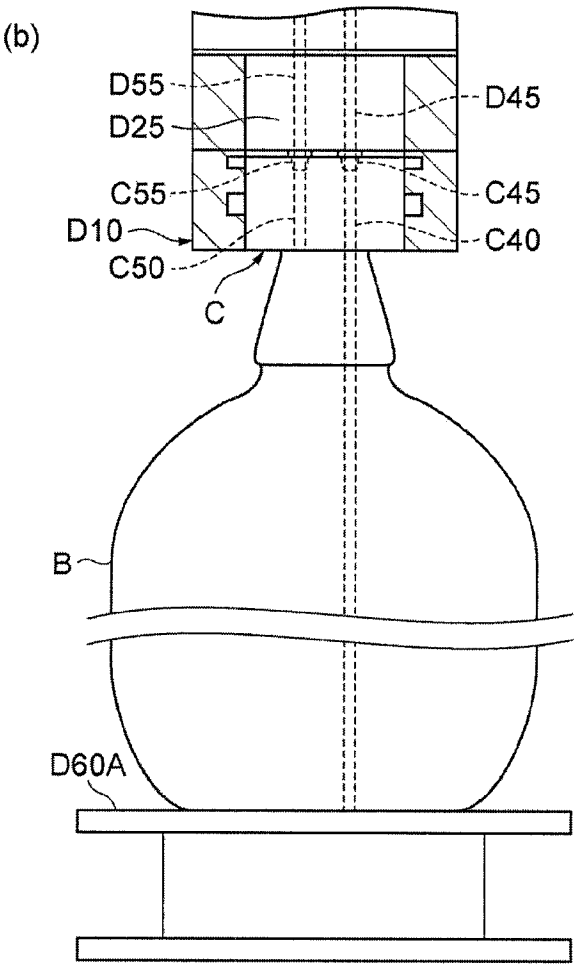
Figure 22:
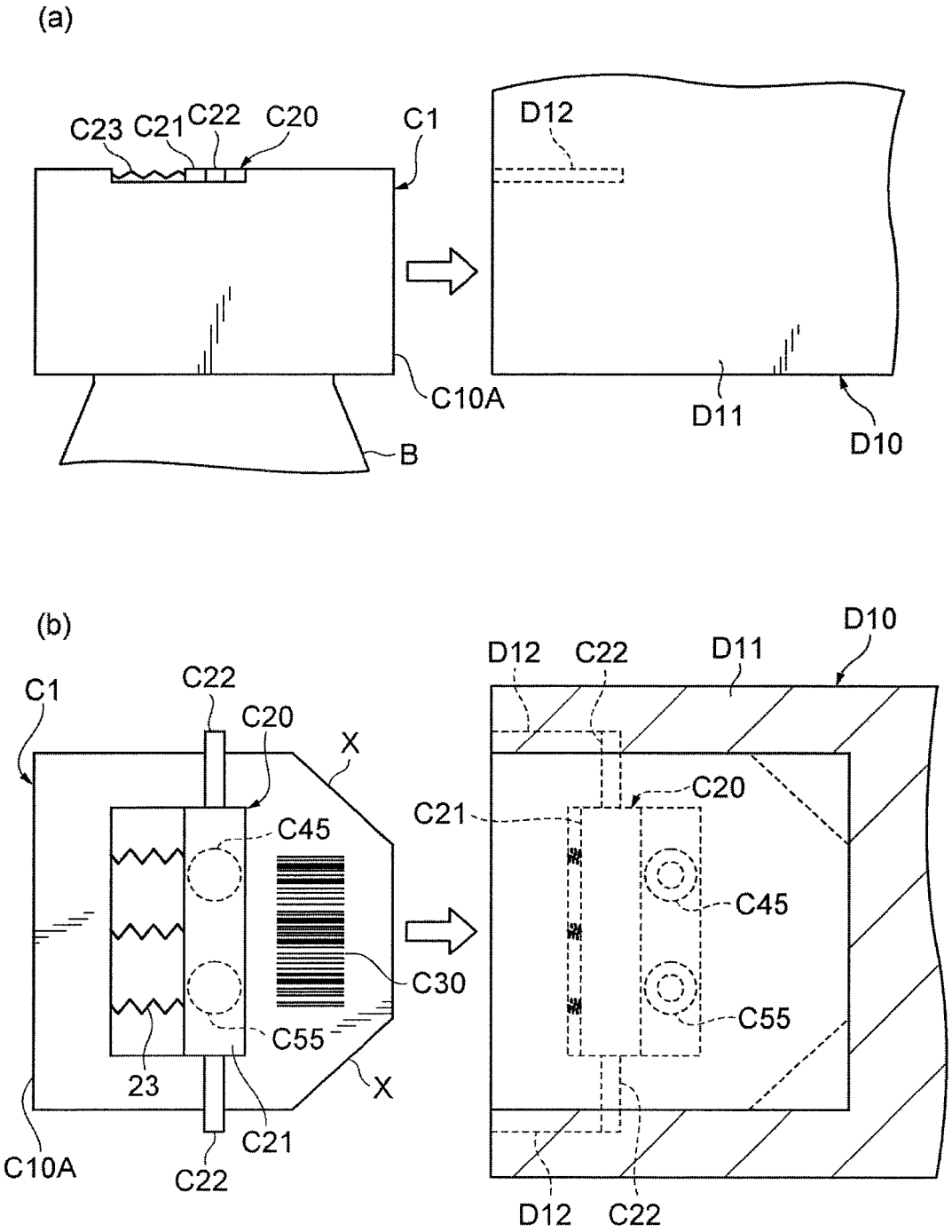
Figure 23:
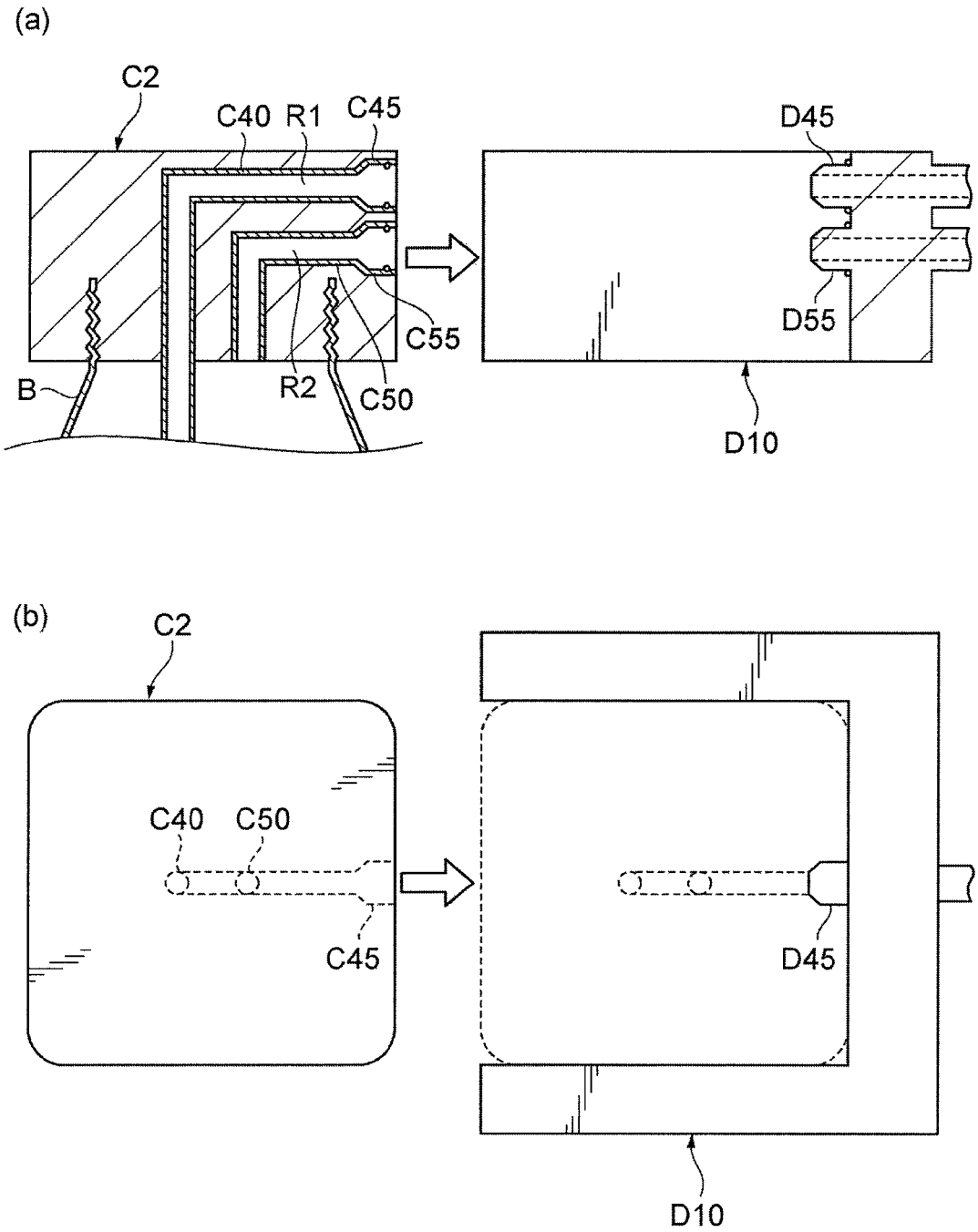
Figure 24:
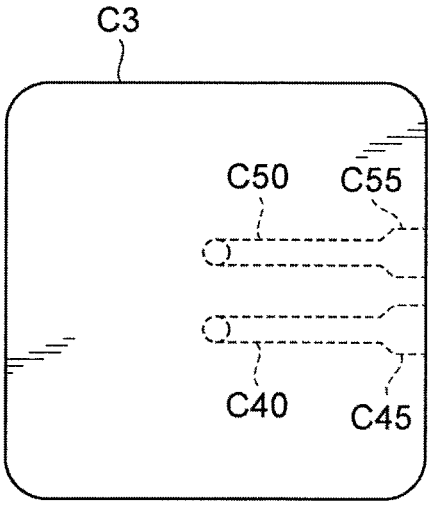
Figure 24:
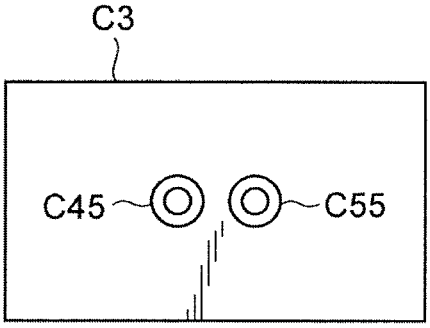
Figure 25:
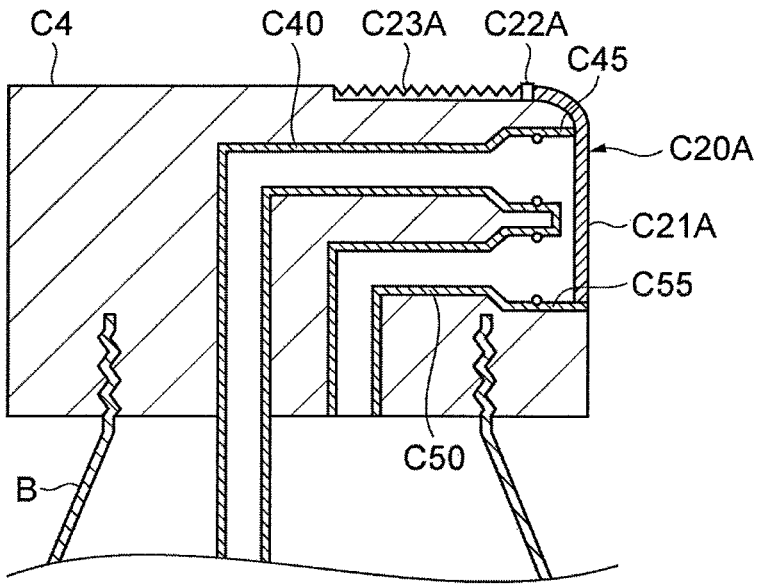
Figure 25:
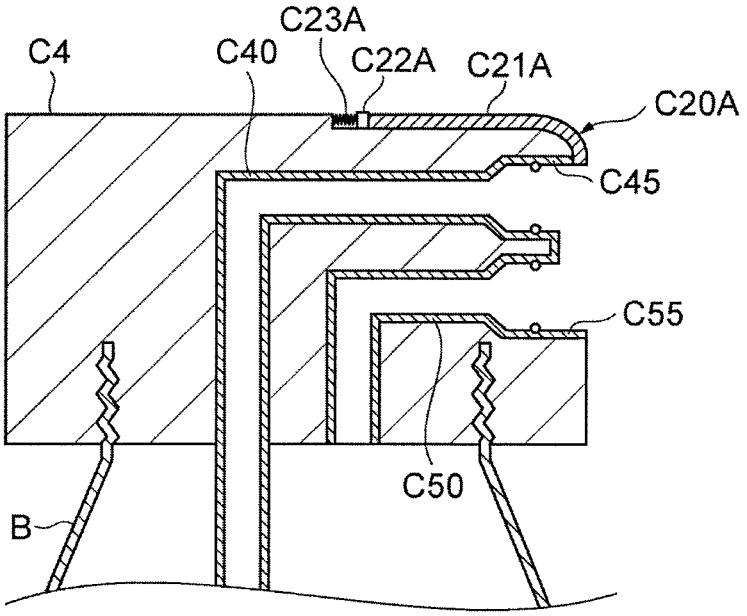
Figure 26:
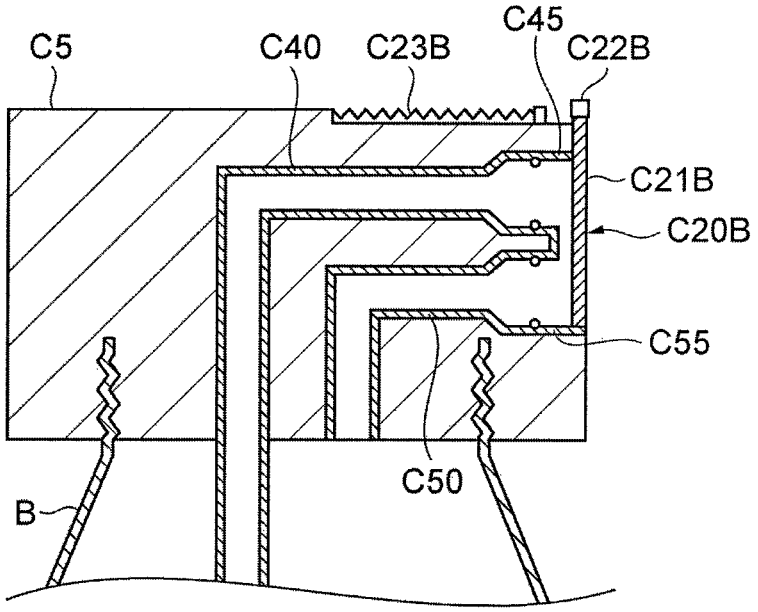
Figure 26:
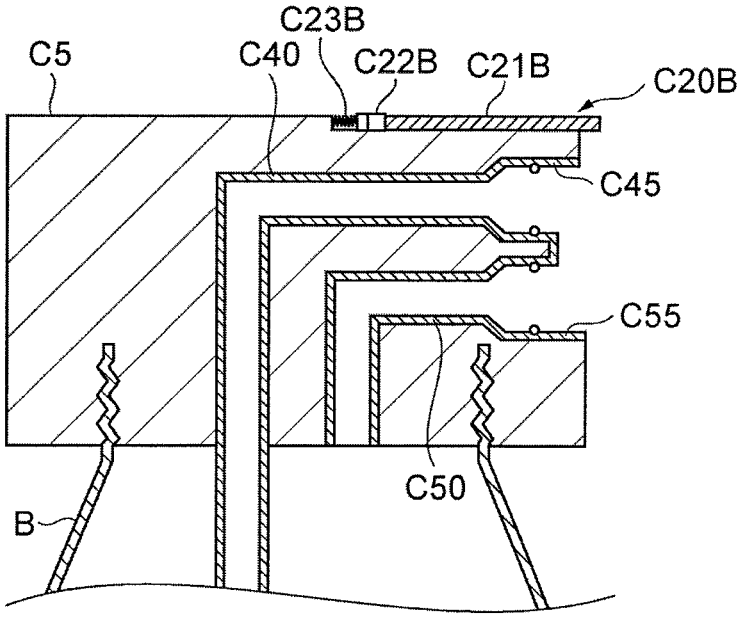
Figure 27:
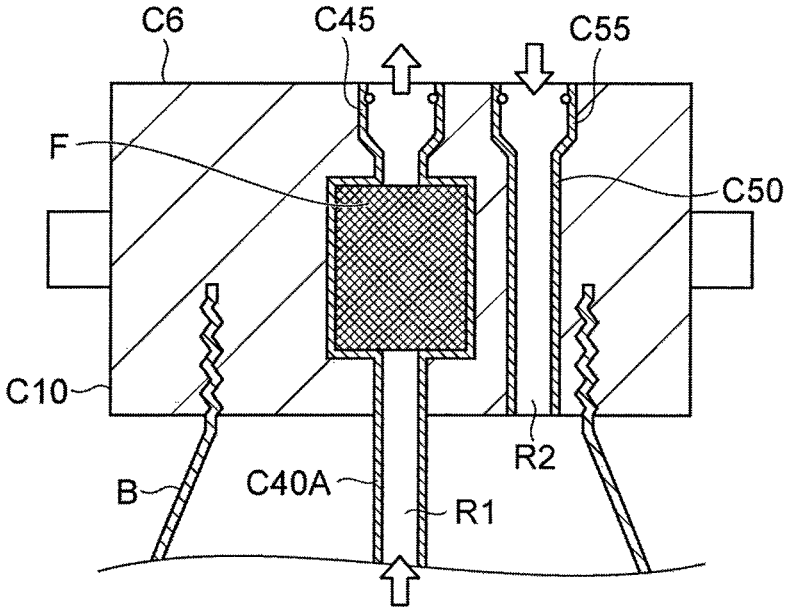
Figure 28:
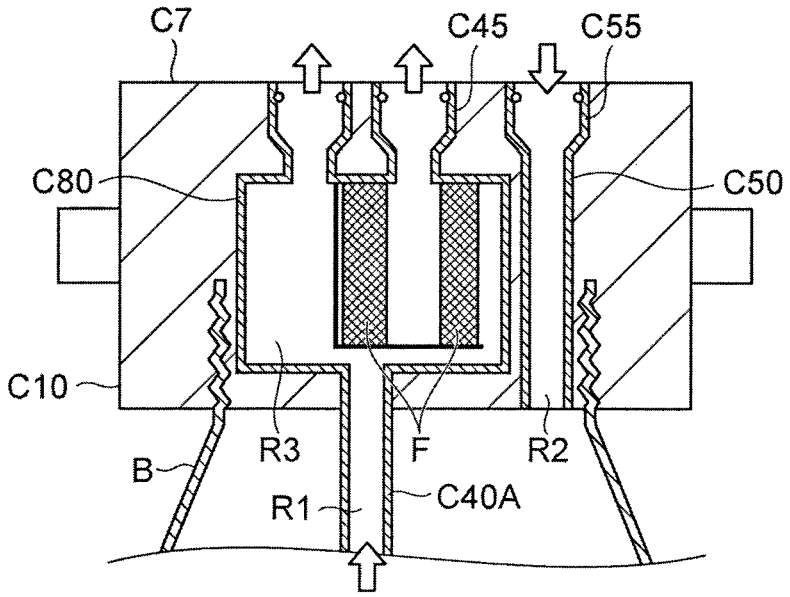

(a) of FIG. 5 is a cross-sectional view taken along a line Va-Va in FIG. 4(*a*), (*b*) of FIG. 5 is a cross-sectional view taken along a line Vb-Vb in FIG. 4(*b*);

FIG. 6 is a view illustrating the appearance that a bottle is set on a chemical cart, (a) of FIG. 6 being a side view and (b) of FIG. 6 being a front view of the chemical cart viewed from the side to which the bottle is connected;

FIG. 7 is a view illustrating the appearance that the cap is fitted into a guide part, (a) of FIG. 7 being a side view and (b) of FIG. 7 being a top view;

FIG. 8 is a view illustrating the appearance that the cap has been fitted into the guide part, (a) of FIG. 8 being a side view and (b) of FIG. 8 being a top view;

FIG. 9 is a view illustrating the appearance that a treatment solution connecting part and so on and a treatment solution pipe and so on are connected together, (a) of FIG. 9 being a cross-sectional view illustrating the state before connection and (b) of FIG. 9 being a cross-sectional view illustrating the state after connection;

FIG. 10 is a functional block diagram illustrating a control unit;

FIG. 11 is a flowchart illustrating the flow of the processing of changing the bottle;

FIG. 12 is a view illustrating the appearance that the bottle is changed, (a) of FIG. 12 being a side view and (b) of FIG. 12 being a front view;

FIG. 13 is a side view illustrating the appearance that the bottle is changed;

FIG. 14 is a view illustrating the appearance that the bottle is changed, (a) of FIG. 14 being a side view and (b) of FIG. 14 being a front view;

FIG. 15 is a side view illustrating the appearance that the bottle is changed;

FIG. 16 is a view illustrating the appearance that the bottle is changed, (a) of FIG. 16 being a side view and (b) of FIG. 16 being a front view;

FIG. 17 is a side view illustrating the appearance that the bottle is changed;

FIG. 18 is a view illustrating the appearance that the bottle is changed, (a) of FIG. 18 being a side view and (b) of FIG. 18 being a front view;

(a) of FIG. 19 to (f) of FIG. 19 are explanatory views illustrating the appearance that a cap change apparatus changes the cap;

FIG. 20 is a view illustrating a modification example of a connection mechanism part, (a) of FIG. 20 being a cross-sectional view illustrating the state before connection and (b) of FIG. 20 being a cross-sectional view illustrating the connected state;

FIG. 21 is a view illustrating a modification example of connecting pipes together by raising and lowering the bottle, (a) of FIG. 21 being a front view illustrating the state before connection and (b) of FIG. 21 being a front view illustrating the connected state by raising the bottle;

FIG. 22 is a view illustrating the appearance that a cap according to a modification example is fitted into the guide part, (a) of FIG. 22 being a side view and (b) of FIG. 22 being a top view;

FIG. 23 is a view illustrating the appearance that a cap according to a modification example is fitted into the guide part, (a) of FIG. 23 being a side view and (b) of FIG. 23 being a top view;

FIG. 24 is a view illustrating a cap according to a modification example, (a) of FIG. 24 being a top view and (b) of FIG. 24 being a side view;

FIG. 25 is a cross-sectional view illustrating opening/closing states of a cover provided on a cap having the treatment solution connecting part and so on at its side surface, (a) of FIG. 25 being a view illustrating the state that the cover is closed and (b) of FIG. 25 being a view illustrating the state the cover is opened;

FIG. 26 is a cross-sectional view illustrating a modification example of a cover provided on a cap having the treatment solution connecting part and so on at its side surface, (a) of FIG. 26 being a view illustrating the state that the cover is closed and (b) of FIG. 26 being a view illustrating the state the cover is opened;

FIG. 27 is a cross-sectional view illustrating a cap having a filter in a treatment solution flow passage; and FIG. 28 is a cross-sectional view illustrating a modification example of the cap having the filter in the treatment solution flow passage.

DETAILED DESCRIPTION OF THE INVENTION

Hereinafter, an embodiment of the present invention will be described referring to the drawings. Note that the same reference numerals are given to the same elements in the description of the drawings to omit repeated description.

Figure 1:
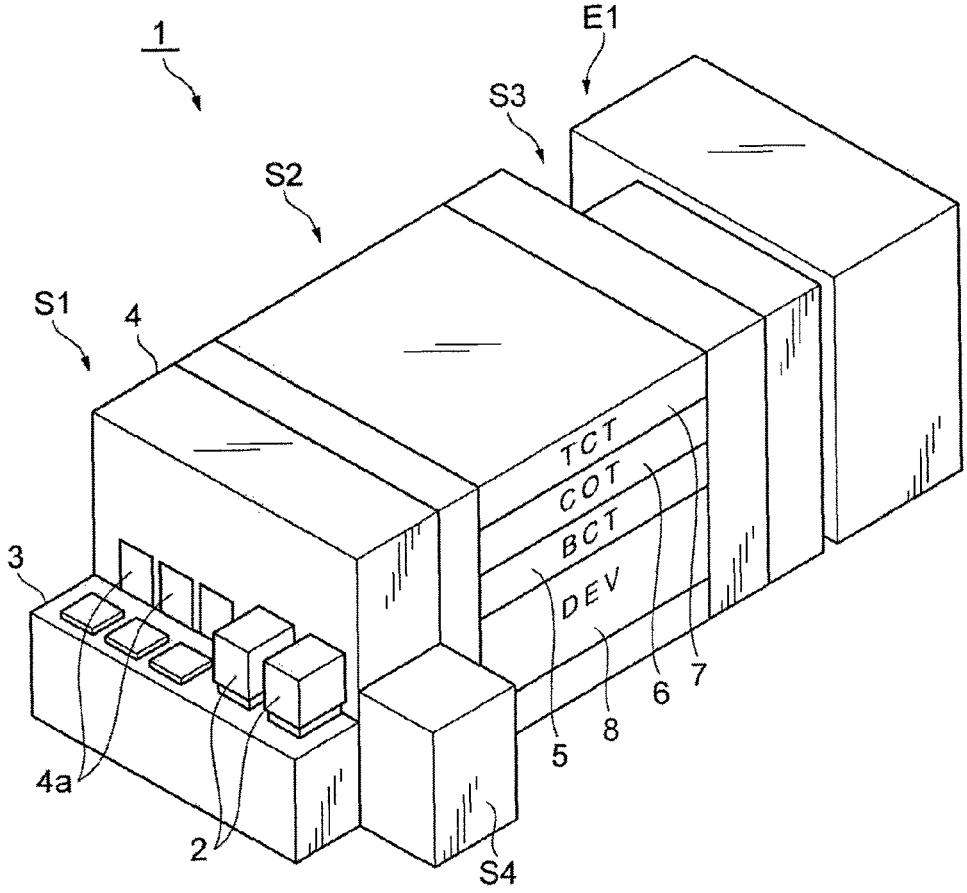
FIG. 1 is a perspective view illustrating a coating and developing apparatus according to an embodiment.

A coating and developing apparatus (substrate treatment apparatus) 1 includes a carrier block S1, a treatment block S2 adjacent to the carrier block S1, an interface block S3 adjacent to the treatment block S2, and a treatment solution supply block S4 as illustrated in FIG. 1.

The carrier block S1 has a carrier station 3 for setting a plurality of carriers 2 thereon, and a transfer-in and transfer-out unit 4 intervening between the carrier station 3 and the treatment block S2. The carrier 2 houses a plurality of wafers in a sealed state and detachably set on the carrier station 3. One side surface of the carrier 2 is provided with an opening/closing door for taking in/out the wafers. The transfer-in and transfer-out unit 4 is provided with a plurality of opening/closing doors 4*a* corresponding to the plurality of carriers 2 set on the carrier station 3, respectively. In the transfer-in and transfer-out unit 4, a delivery arm is housed which takes the wafer out of the carrier 2 set on the carrier station 3 and passes the wafer to the treatment block S2, and receives the wafer from the treatment block S2 and returns the wafer into the carrier 2.

The treatment block S2 has a lower anti-reflection film forming (BCT) block 5 as a substrate treatment unit which forms a lower anti-reflection film on the front surface of the wafer, a resist film forming (COT) block 6 as a substrate treatment unit which forms a resist film on the lower anti-reflection film, an upper anti-reflection film forming (TCT) block 7 as a substrate treatment unit which forms an upper anti-reflection film on the resist film, and a developing treatment (DEV) block 8 as a substrate treatment unit which performs developing treatment. Those blocks are stacked in the order of the DEV block 8, the BCT block 5, the COT block 6, and the TCT block 7 from the floor surface side.

The interface block S3 is connected to an exposure apparatus E1 that performs exposure processing on the wafer. In the interface block S3, a delivery arm is housed which passes the wafer from the treatment block S2 to the exposure apparatus E1 and receives the wafer after the exposure processing from the exposure apparatus E1 and returns the wafer to the treatment block S2.

The treatment solution supply block S4 supplies the treatment block S2 with treatment solutions used when the BCT block 5 or the like in the treatment block S2 perform treatments on the wafer. Note that the position where the treatment solution supply block S4 is provided is not limited to the position illustrated in FIG. 1, and the number of treatment solution supply blocks S4 is not limited to one. The configuration of the treatment solution supply block S4 will be described later in detail.

In the coating and developing apparatus 1, first, the carrier 2 housing a plurality of wafers is set on the carrier station 3. Then, both of the opening/closing door of the carrier 2 and the opening/closing door 4*a* of the transfer-in and transfer-out unit 4 are opened, and the delivery arm installed in the transfer-in and transfer-out unit 4 transfers the wafer in the carrier 2 into the transfer-in and transfer-out unit 4. The wafer transferred into the transfer-in and transfer-out unit 4 is transferred to the BCT block 5 in the treatment block S2.

In the BCT block 5, a lower anti-reflection film is formed on the front surface of the wafer. The wafer on which the lower anti-reflection film has been formed in the BCT block 5 is transferred to the COT block 6. In the COT block 6, a resist film is formed on the lower anti-reflection film of the wafer.

The wafer on which the resist film has been formed in the COT block 6 is transferred to the TCT block 7. In the TCT block 7, an upper anti-reflection film is formed on the resist film of the wafer. The wafer on which the upper anti-reflection film has been formed in the TCT block 7 is transferred into the exposure apparatus E1.

In the exposure apparatus E1, exposure processing is performed on the resist film of the wafer transferred thereto. The wafer after the exposure processing is transferred to the DEV block 8. In the DEV block 8, post-exposure bake (PEB) treatment, developing treatment, and post-bake treatment are performed on the wafer. The wafer subjected to the post-bake treatment is transferred from the DEV block 8 to the carrier 2.

Note that the configuration of the coating and developing apparatus 1 is merely one example. The coating and developing apparatus only needs to include treatment units such as a coating unit, a developing treatment unit and so on, pre-treatment and post-treatment units such as a heating and cooling unit, and a transfer apparatus. The numbers, kinds, layout and so on of those units can be arbitrarily changed.

Figure 2:
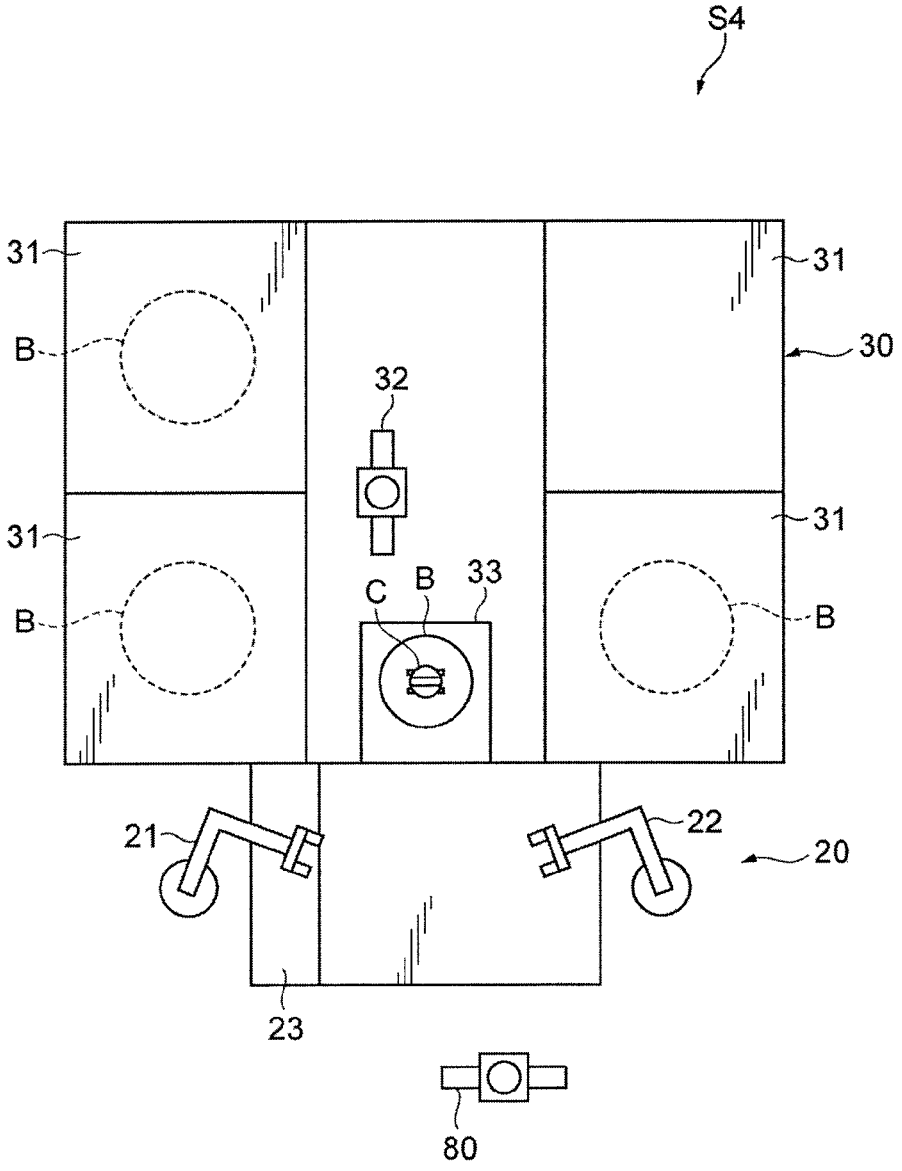
FIG. 2 is a plan view illustrating a schematic configuration of a treatment solution supply block.

Next, the details of the treatment solution supply block S4 will be described. As illustrated in FIG. 2, the treatment solution supply block S4 is configured to include a cap change apparatus 20 and a bottle change apparatus 30. Here, the treatment solution supply block S4 supplies a treatment solution housed in a bottle B to the BCT block 5 or the like in the treatment block S2.

The cap change apparatus 20 is configured to include a first arm 21, a second arm 22, and a straw cleaning unit 23. Into the cap change apparatus 20, the bottle B storing a treatment solution is transferred from a bottle storage location (predetermined position) by a transfer apparatus (bottle transfer mechanism) 80. As the transfer apparatus 80, for example, a crane can be used. Further, a robot arm or a belt conveyor, other than the crane, can also be used as the transfer apparatus 80. The first arm 21 and the second arm 22 change a cap (bottle cap) C with straw (see FIG. 3) attached to an opening portion of an empty bottle B received from the bottle change apparatus 30 with a cap for transfer time attached to an opening portion of a new bottle B transferred from the bottle storage location.

After the cap C with straw is attached to the new bottle B, the first arm 21 or the second arm 22 delivers the new bottle having the cap C attached thereto to an alignment stage 33 in the bottle change apparatus 30. A change work of the cap C in the cap change apparatus 20 will be described later in detail. Note that the cap change apparatus 20 does not need to be provided near the coating and developing apparatus 1, but may be provided at a place different from the coating and developing apparatus 1. Further, in the case where the cap C with straw is originally attached to the bottle B, it is unnecessary to provide the cap change apparatus 20.

The bottle change apparatus 30 is configured to include a plurality of chemical carts (change mechanisms) 31, a crane (bottle transfer mechanism) 32, and the alignment stage 33. At the chemical cart 31, one end of a treatment solution pipe connected to the BCT block 5 or the like in the treatment block S2 is located. To the bottle B transferred to the chemical cart 31, the treatment solution pipe is connected to supply the treatment solution from the chemical cart 31 to the BCT block 5 or the like.

The crane 32 is an OHT (Overhead Hoist Transfer) running on a track set on the ceiling of the treatment solution supply block S4, as an example, and transfers the bottle B between the chemical cart 31 and the alignment stage 33 while grasping the bottle B.

The alignment stage 33 rotates the bottle B to an orientation in which the bottle B is easily grasped by the crane 32. Note that the alignment stage 33 can monitor orientations and so on of cap guides C60 (see FIG. 3(*b*)) of the cap C attached to the bottle B by a camera, and rotate the bottle B on the basis of the monitoring result.

Figure 3:
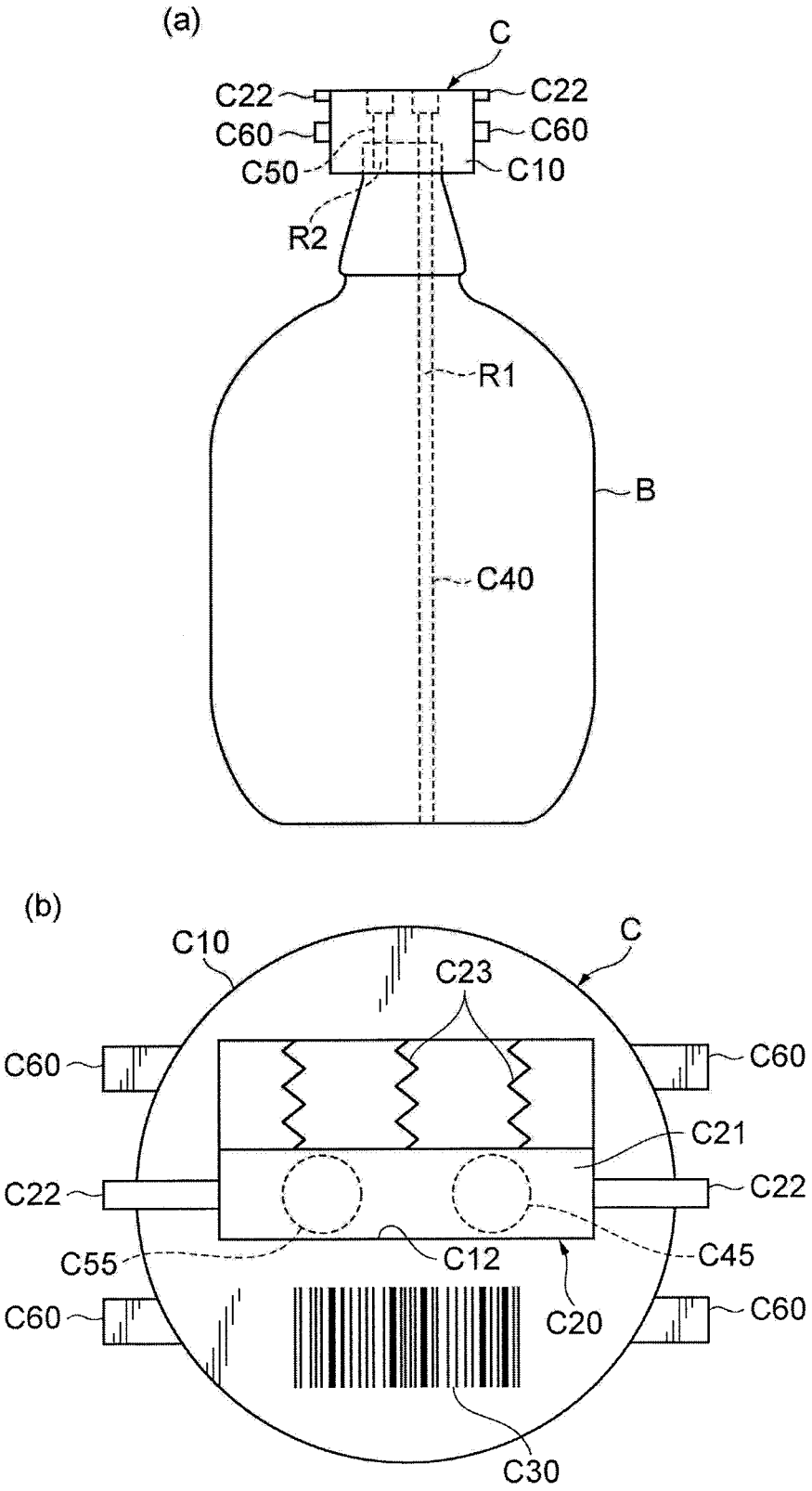
FIG. 3 is a view illustrating a bottle, (a) of FIG. 3 being a side view and (b) of FIG. 3 being a top view.

Next, the cap C to be attached to the opening portion of the bottle B will be described. As illustrated in FIG. 3 to FIG. 5, the cap C is screwed into the opening portion provided at an upper portion of the bottle B and thereby attached thereto. The cap C is configured to include a cap main body C10, a cover (treatment solution cover) C20, a tag C30, a treatment solution straw part C40, a gas flow passage forming part C50, and four cap guide C60.

The cap main body C10 is formed with an engagement part C11 that is screwed into the opening portion of the bottle B and thereby engages with the bottle B. The cap main body C10 seals the opening portion of the bottle B when it is attached to the bottle B.

The treatment solution straw part C40 forms a treatment solution flow passage R1 for supplying the treatment solution in the bottle B to the outside of the bottle B. One end side of the treatment solution straw part C40 is buried in the cap main body C10, and the other end side extends toward the bottom portion of the bottle B. The treatment solution flow passage R1 at one end side portion (end portion outside the bottle B) of the treatment solution straw part C40 extends along the vertical direction.

At one end side of the treatment solution straw part C40, a treatment solution connecting part C45 is provided. The treatment solution connecting part C45 is connected to a treatment solution pipe D45 (see FIG. 6(*b*)) which is provided at the chemical cart 31 and through which the treatment solution supplied from the bottle B flows. The treatment solution pipe D45 extends from the chemical cart 31 to the BCT block 5 or the like. In this embodiment, the treatment solution connecting part C45 is formed by increasing the diameter at one end of the treatment solution straw part C40. On the inner peripheral surface of the treatment solution connecting part C45, an O-ring S is attached to increase the sealing property with the treatment solution pipe D45.

The gas flow passage forming part C50 forms a gas flow passage R2 for supplying gas (nitrogen gas as an example) into the bottle B from the outside of the bottle B. The gas flow passage forming part C50 is buried in the cap main body C10. The gas flow passage R2 at one end side portion (end portion outside the bottle B) of the gas flow passage forming part C50 extends along the vertical direction. By supplying the gas into the bottle B through the gas flow passage R2, the treatment solution in the bottle B is pushed out to the outside of the bottle B through the treatment solution flow passage R1.

On one end side of the gas flow passage forming part C50, a gas connecting part C55 is provided. The gas connecting part C55 is connected to a gas pipe D55 (see FIG. 9) which is provided at the chemical cart 31 and through which the gas to be supplied to the bottle B flows. In this embodiment, the gas connecting part C55 is formed by increasing the diameter at one end of the gas flow passage forming part C50. On the inner peripheral surface of the gas connecting part C55, for example, an O-ring S is attached.

Note that the treatment solution straw part C40 forming the treatment solution flow passage R1 and the gas flow passage forming part C50 forming the gas flow passage R2 are separate bodies from the cap main body C10 in the embodiment, but the treatment solution straw part C40 and the cap main body C10 may be integrally molded and the gas flow passage forming part C50 and the cap main body C10 may be integrally molded.

The cover 20 is configured to include a cover main body C21, a pair of cover guides C22, and springs C23. The cover main body C21 covers the treatment solution connecting part C45 and the gas connecting part C55 to be exposable at the upper surface of the cap main body C10. The springs C23 urge the cover main body C21 in a direction in which the cover guides C22 cover the treatment solution connecting part C45 and the gas connecting part C55. Note that a stopper part C12 that stops slide of the cover main body C21 at a position where the treatment solution connecting part C45 and the gas connecting part C55 are covered when the cover main body C21 is urged by the springs C23, is provided in the upper surface of the cap main body C10.

The pair of cover guides C22 are arranged to sandwich the cover main body C21 between them, and connected to side portions of the cover main body C21 respectively. The pair of cover guides C22 extend along a direction perpendicular to the direction in which the cover main body C21 is urged by the springs C23, from the side portions of the cover main body C21 to the outside, respectively.

The four cap guides C60 are divided into groups of two of them, and arranged such that the cap guides C60 in one group and the cap guides C60 in the other group sandwich the cap main body C10 between them. The cap guides C60 in one group and the cap guides C60 in the other group are connected to the side portions of the cap main body C10, respectively. The cap guides C60 in one group and the cap guides C60 in the other group extend along the direction perpendicular to the direction in which the cover main body C21 is urged by the springs C23, from the side portions of the cap main body C10 to the outside, respectively.

In the tag C30, information relating to the treatment solution such as the kind, the expiration date and so on of the treatment solution in the bottle B is recorded. As the tag C30, for example, a barcode or the like which can be read by the camera and so on can be used.

Next, details of the chemical cart 31 will be described. The chemical cart 31 sucks the treatment solution out of the bottle B and supplies the sucked treatment solution to a predetermined block using the treatment solution such as the BCT block 5, the COT block 6, the TCT block 7, the DEV block 8 and so on in the treatment block S2.

As illustrated in FIG. 6, the chemical cart 31 is configured to include a guide part D10, a connection mechanism part D20, a camera D30, and a slide and rotation mechanism part (bottle mounting part) D60. The guide part D10 is provided at a position below the connection mechanism part D20, and positions the bottle B so that the treatment solution pipe D45 and the gas pipe D55 are connected to the cap C of the bottle B by the connection mechanism part D20.

Explaining in more detail, the guide part D10 is configured to include a pair of wall parts D11, a pair of cover guide grooves D12, and a pair of cap guide grooves D13 as illustrated in FIG. 7 and FIG. 8. The pair of wall parts D11 are arranged to sandwich the cap main body C10 of the cap C attached to the bottle B between them.

The pair of cap guide grooves D13 are provided in surfaces where the pair of wall parts D11 face each other, respectively. The cap guide grooves D13 extend along a direction in which the bottle B is transferred from one end portion (end portion on the side where the cap C is fitted) of the guide part D10 toward a position where the bottle B is connected to the treatment solution pipe D45 and so on. Into the cap guide grooves D13, the cap guides C60 of the cap C are fitted to be slidable from one end portion side of the guide part D10 when the bottle B is transferred by the slide and rotation mechanism part D60 toward the position where the bottle B is connected to the treatment solution pipe D45 and so on.

The groove length of the cap guide grooves D13 from the one end portion of the guide part D10 is set to a length with which the bottle B is connected to the treatment solution pipe D45 and so on when the cap guides C60 come into contact with end portions D13*a* on the groove back side of the cap guide grooves D13 as illustrated in FIG. 8(*a*) and FIG. 8(*b*).

Sandwiching the cap main body C10 of the cap C between the pair of wall parts D11 makes it possible to position the cap C in the direction perpendicular to the transfer direction when the bottle B is transferred by the slide and rotation mechanism part D60 toward the position where the bottle B is connected to the treatment solution pipe D45 and so on. Further, setting the groove length of the cap guide grooves D13 to the above-described length makes it possible to position the cap C in the transfer direction when the bottle B is transferred by the slide and rotation mechanism part D60.

The pair of cover guide grooves D12 are provided in the surfaces where the pair of wall parts D11 face each other, respectively. The cover guide grooves D12 extend in parallel with the cap guide grooves D13 from one end portions of the wall parts D11. Into the cover guide grooves D12, the cover guides C22 of the cover 20 are fitted to be slidable from one end portion side of the guide part D10 when the bottle B is transferred by the slide and rotation mechanism part D60 toward the position where the bottle B is connected to the treatment solution pipe D45 and so on.

Further, at the time when the bottle B is transferred by the slide and rotation mechanism part D60 toward the position where the bottle B is connected to the treatment solution pipe D45 and so on, end portions D12*a* on the groove back side of the cover guide grooves D12 come into contact with the cover guides C22 to slide the cover main body C21 and thereby expose the treatment solution connecting part C45 and the gas connecting part C55 as illustrated in FIG. 8(*a*) and FIG. 8(*b*). The groove length of the cover guide grooves D12 from the one end portion is set to a length with which the cover main body C21 slides to expose the treatment solution connecting part C45 and the gas connecting part C55 when the cap guides C60 come into contact with the end portions D13*a* on the groove back side of the cap guide grooves D13.

Setting the groove length of the cover guide grooves D12 to the above-described length makes it possible to automatically slide the cover main body C21 to expose the treatment solution connecting part C45 and the gas connecting part C55 when the bottle B is transferred by the slide and rotation mechanism part D60. In contrast, by detaching the bottle B from the guide part D10, the springs C23 urge the cover main body C21 so that the treatment solution connecting part C45 and the gas connecting part C55 are covered by the cover main body C21.

To the connection mechanism part D20, the treatment solution pipe D45 through which the treatment solution to be supplied from the bottle B to the BCT block 5 or the like flows and the gas pipe D55 through which the gas to be supplied into the bottle B flows, are connected. The connection mechanism part D20 raises and lowers the end portions of the treatment solution pipe D45 and the gas pipe D55 along the vertical direction to connect the treatment solution pipe D45 and the treatment solution connecting part C45 provided at the cap C together or release the connection therebetween. Further, the connection mechanism part D20 raises and lowers the end portions of the treatment solution pipe D45 and the gas pipe D55 along the vertical direction to connect the gas pipe D55 and the gas connecting part C55 provided at the cap C together or release the connection therebetween.

Explaining in more detail, the connection mechanism part D20 is configured to include a raising and lowering part D21 and a rotation part D22 as illustrated in FIG. 9(*a*) and FIG. 9(*b*). The raising and lowering part D21 has a cylindrical shape. The raising and lowering part D21 is arranged such that its axial direction of the cylindrical shape is parallel with the vertical direction. To the raising and lowering part D21, the end portion of the treatment solution pipe D45 and the end portion of the gas pipe D55 are connected from the upper surface of the raising and lowering part D21. The end portion of the treatment solution pipe D45 and the end portion of the gas pipe D55 project from the lower surface of the raising and lowering part D21 by a predetermined length to constitute connecting portions with the treatment solution connecting part C45 and the gas connecting part C55 respectively. At regions of the end portion of the treatment solution pipe D45 and the end portion of the gas pipe D55 projecting from the lower surface of the raising and lowering part D21, O-rings S are attached respectively. At the peripheral surface of the raising and lowering part D21, a projecting portion D21*a* is provided.

The rotation part D22 has a cylindrical shape. The rotation part D22 is arranged such that its axial direction of the cylindrical shape is parallel with the vertical direction. The rotation part D22 houses the raising and lowering part D21 to be rotatable therein. In the inner peripheral surface of the rotation part D22, a raising and lowering guide groove D22*a* is provided. The raising and lowering guide groove D22*a* extends along a direction inclining with respect to the axial direction of the cylindrical shape of the rotation part D22. Into the raising and lowering guide groove D22*a*, the projecting portion D21*a* of the raising and lowering part D21 is fitted. The rotation part D22 is rotated by a not-illustrated drive source using the axis of the cylindrical shape as the rotation axis.

The rotation part D22 is supported to be rotatable by the guide part D10. Further, the position in the vertical direction of the rotation part D22 does not change even if the rotation part D22 is rotated. Therefore, when the rotation part D22 is rotated, the raising and lowering part D21 is raised and lowered along the vertical direction because the projecting portion D21*a* of the raising and lowering part D21 is fitted into the raising and lowering guide groove D22*a*.

The rotation part D22 is rotated to lower the raising and lowering part D21, whereby the treatment solution pipe D45 and the gas pipe D55 are moved to the lower side and connected to the treatment solution connecting part C45 and the gas connecting part C55 of the bottle B, respectively. Namely, by bringing the treatment solution pipe D45 close to the treatment solution connecting part C45 from the upper direction along the extending direction (vertical direction) of the treatment solution flow passage R1 at the one end side portion (end portion outside the bottle B) of the treatment solution straw part C40 to press the treatment solution pipe D45 against the treatment solution connecting part C45, the treatment solution connecting part C45 and the treatment solution pipe D45 are connected together. Similarly, by bringing the gas pipe D55 close to the gas connecting part C55 from the upper direction along the extending direction of the gas flow passage R2 at the one end side portion of the gas flow passage forming part C50 to press the gas pipe D55 against the gas connecting part C55, the gas connecting part C55 and the gas pipe D55 are connected together.

On the other hand, when the rotation part D22 is rotated in the opposite direction, the raising and lowering part D21 is raised to move the treatment solution pipe D45 and the gas pipe D55 to the upper side, thereby releasing the connections between the treatment solution connecting part C45 and the gas connecting part C55 of the bottle B, and, the treatment solution pipe D45 and the gas pipe D55.

The rotation part D22 is rotated to raise and lower the raising and lowering part D21, thereby making it possible to connect the treatment solution pipe D45 and the gas pipe D55 with the treatment solution connecting part C45 and the gas connecting part C55 of the bottle B or release the connections therebetween. Note that tip end portions of the treatment solution pipe D45 and the gas pipe D55 are inserted into the treatment solution connecting part C45 and the gas connecting part C55 respectively and thereby connected thereto.

In the inner peripheral surface of the rotation part D22, a cutout D22*b* is provided which extends upward from the end portion on the upper side of the raising and lowering guide groove D22*a*. Providing the cutout D22*b* makes it possible to fit the projecting portion D21*a* of the raising and lowering part D21 into the raising and lowering guide groove D22*a* via the cutout D22*b*. For example, if the cutout D22*b* is provided at the end portion on the lower side of the raising and lowering guide groove D22*a*, the projecting portion D21*a* is considered to drop to the lower side through the cutout D22*b* when the raising and lowering part D21 is moved to the lower side. Therefore, the cutout D22*b* is provided at the end portion on the upper side of the raising and lowering guide groove D22*a*, thereby making it possible to prevent drop of the raising and lowering part D21. Further, the projecting portion D21*a* comes into contact with the end portion on the lower side of the raising and lowering guide groove D22*a* when the raising and lowering part D21 is moved to the lower side, to perform positioning of the raising and lowering part D21 when it is moved to the lower side.

Note that the raising and lowering part D21 may be engaged with a guide and so on that regulate the rotation of the raising and lowering part D21 so as not to rotate together with the rotation part D22 when it is rotated.

The slide and rotation mechanism part D60 transfers the bottle B between the position to which the bottle B has been transferred into the chemical cart 31 by the crane 32 and the position where the treatment solution pipe D45 and so on are to be connected to the cap C of the bottle B by the connection mechanism part D20. The slide and rotation mechanism part D60 has a function of sliding the bottle B in the horizontal direction and a function of rotating the bottle B. The slide and rotation mechanism part D60 slides the bottle B in the horizontal direction to fit the cap C into the guide part D10.

Further, the slide and rotation mechanism part D60 rotates the bottle B to an orientation in which the cap C can be fitted into the guide part D10 and an orientation in which the bottle B is easily grasped by the crane 32. Note that the slide and rotation mechanism part D60 can monitor the orientation and so on of the cap guides C60 (see FIG. 3(*b*)) of the cap C attached to the bottle B by the camera D30, and rotate the bottle B on the basis of the monitoring result.

The camera D30 images the cap C from above on a transfer route between the position to which the bottle B has been transferred into the chemical cart 31 by the crane 32 and the position where the treatment solution pipe D45 and so on are to be connected to the cap C of the bottle B by the connection mechanism part D20. The imaging result by the camera D30 is used for determining the orientation of the cap C. Further, the imaging result by the camera D30 is used for reading the tag C30 attached to the upper surface of the cap C.

Next, a control unit that controls the cap change apparatus 20, the bottle change apparatus 30, and the transfer apparatus 80 that transfers the bottle B to the cap change apparatus 20 will be described. As illustrated in FIG. 10, a control unit 300 is configured to include a transfer control unit 310, a cap change control unit 320, a slide and rotation mechanism control unit 330, an image processing unit 340, and a connection control unit 350. Note that the control unit 300 may be installed in the treatment solution supply block S4, and may be integrally provided with a control unit that controls the whole coating and developing apparatus 1.

The transfer control unit 310 controls the transfer apparatus 80 so that the bottle B is transferred between the bottle storage location and the cap change apparatus 20, and controls the crane 32 and the alignment stage 33 so that the bottle B is transferred between the alignment stage 33 and the chemical cart 31.

The cap change control unit 320 controls the first arm 21 and the second arm 22 so that the cap C with straw attached to the opening portion of the empty bottle B received from the bottle change apparatus 30 is changed with the cap C for transfer time attached to the opening portion of the new bottle B transferred from the bottle storage location.

The slide and rotation mechanism control unit 330 controls the slide and rotation mechanism part D60 so that the bottle B is transferred between the position to which the bottle B has been transferred into the chemical cart 31 by the crane 32 and the position where the treatment solution pipe D45 and so on are to be connected to the cap C of the bottle B by the connection mechanism part D20. The slide and rotation mechanism control unit 330 further controls the slide and rotation mechanism part D60 so that the bottle B is rotated to an orientation in which the cap C can be fitted into the guide part D10 and an orientation in which the bottle B is easily grasped by the crane 32.

The image processing unit 340 detects the orientation of the bottle B on the basis of the image imaged by the camera D30. The image processing unit 340 further reads the tag C30 attached to the upper surface of the cap C to grasp the kind and so on of the treatment solution in the bottle B.

The connection control unit 350 controls the rotation of the rotation part D22 to move the raising and lowering part D21 up and down to connect the treatment solution pipe D45 and the gas pipe D55 to the treatment solution connecting part C45 and the gas connecting part C55 of the bottle B or release the connections therebetween.

Note that into the control unit 300, a detection result of a remaining amount detection sensor (remaining amount detection unit) 400 that detects the remaining amount of the treatment solution in the bottle B that supplies the treatment solution at the chemical cart 31 is inputted. On the basis of the detection result by the remaining amount detection sensor 400, the control unit 300 performs a charge work of the bottle B. Note that the remaining amount detection sensor 400 may detect the remaining amount of the treatment solution in a buffer tank that temporarily stores the treatment solution supplied from the bottle B, and may detect the remaining amount of the treatment solution on the basis of the flow rate of the treatment solution flowing through the treatment solution pipe D45. Further, the remaining amount detection sensor 400 can detect the remaining amount of the treatment solution by various methods such as detection of the remaining amount of the treatment solution on the basis of the result of imaging using the camera.

Next, the flow of operations of the units and parts in the case of changing the bottle B at the chemical cart 31 will be described using a flowchart illustrated in FIG. 11. First, the transfer control unit 310 determines based on the detection result by the remaining amount detection sensor 400 whether the remaining amount of the treatment solution in the bottle B supplying the treatment solution at the chemical cart 31 has decreased to a predetermined value or less (Step S101). When the remaining amount of the treatment solution is not the predetermined value or less (Step S101: NO), the transfer control unit 310 repeats the determination processing at Step S101. When the remaining amount of the treatment solution is the predetermined amount or less (Step S101: YES), the transfer control unit 310 controls the transfer apparatus 80 to transfer the bottle B storing the treatment solution from the bottle storage location to the cap change apparatus 20 (Step S102).

Next, the connection control unit 350 determines based on the detection result by the remaining amount detection sensor 400 whether the remaining amount of the treatment solution in the bottle B supplying the treatment solution at the chemical art 31 runs out (Step S103). When there is a remaining amount of the treatment solution (Step S103: NO), the connection control unit 350 repeats the determination processing at Step S103. When there is no remaining amount of the treatment solution (Step S103: YES), the control unit 300 controls the units and parts to transfer the empty bottle B to the cap change apparatus 20 (Step S104).

Concretely, the connection control unit 350 rotates the rotation part D22 of the connection mechanism part D20 to raise the raising and lowering part D21 as illustrated in FIG. 12(*a*) and FIG. 12(*b*) to release the connections between the treatment solution pipe D45 and the gas pipe D55, and, the treatment solution connecting part C45 and the gas connecting part C55 of the bottle B.

Next, the slide and rotation mechanism control unit 330 slides the slide and rotation mechanism part D60 as illustrated in FIG. 13 to move the empty bottle B to a position directly below the camera D30. The slide and rotation mechanism control unit 330 then rotates the slide and rotation mechanism part D60 on the basis of the orientation of the cap C detected by the image processing unit 340 so that the cap C is in the orientation in which it is easily grasped by the crane 32. The slide and rotation mechanism control unit 330 then slides the slide and rotation mechanism part D60 to a position where the empty bottle B can be grasped by the crane 32.

Next, the transfer control unit 310 controls the crane 32 to lift the empty bottle B by the crane 32 as illustrated in FIG. 14(*a*) and FIG. 14(*b*), and removes the empty bottle B from the top of the slide and rotation mechanism part D60 as illustrated in FIG. 15. Then, the transfer control unit 310 controls the crane 32 to transfer the lifted empty bottle B to the alignment stage 33. The transfer control unit 310 controls the alignment stage 33 to rotate the empty bottle B so that the bottle B is in the orientation in which it is easily grasped by the first arm 21 or the second arm 22 of the cap change apparatus 20. The cap change control unit 320 controls the first arm 21 or the second arm 22 to transfer the empty bottle B on the alignment stage 33 into the cap change apparatus 20.

When the bottle B storing the treatment solution and the empty bottle B are transferred to the cap change apparatus 20, the cap change control unit 320 changes the cap C with straw attached to the opening portion of the empty bottle B with the cap C for transfer time attached to the opening portion of the new bottle B storing the treatment solution (Step S105). The change work in the cap change apparatus 20 will be described later in detail.

Next, the control unit 300 controls the units and parts to transfer the bottle B storing the treatment solution after the change of the cap to the chemical cart 31 (Step S106). Concretely, the cap change control unit 320 controls the first arm 21 or the second arm 22 to transfer the bottle B storing the treatment solution after the change of the cap onto the alignment stage 33. The transfer control unit 310 controls the alignment stage 33 to rotate the bottle B storing the treatment solution to an orientation in which the bottle B is easily grasped by the crane 32. Then, the transfer control unit 310 transfers the bottle B on the alignment stage 33 to the slide and rotation mechanism part D60 in the chemical cart 31 by the crane 32 as illustrate in FIG. 16(*a*) and FIG. 16(*b*).

Next, the slide and rotation mechanism control unit 330 transfers the bottle B storing the treatment solution to the connection position with the treatment solution pipe D45 and so on (Step S107). Concretely, first, the slide and rotation mechanism control unit 330 slides the slide and rotation mechanism part D60 to move the bottle B storing the treatment solution to a position directly below the camera D30 as illustrated in FIG. 17. Then, the slide and rotation mechanism control unit 330 rotates, based on the orientation of the cap C detected by the image processing unit 340, the slide and rotation mechanism part D60 so that the cap C is in the orientation in which the cap C can be fitted into the guide part D10.

In this event, the image processing unit 340 reads the tag C30 attached to the upper surface of the cap C to grasp the kind and so on of the treatment solution in the bottle B. When the bottle B transferred into the chemical cart 31 is not the bottle B storing the required treatment solution, or when the expiration date has passed, the slide and rotation mechanism control unit 330 does not transfer the bottle B to the connection position with the treatment solution pipe D45. When the bottle B is not the bottle B storing the required treatment solution, the control unit 300 can control the units and parts to perform processing of returning the bottle B to the bottle storage location and so on.

When the bottle B is the bottle B storing the required treatment solution as a result of reading the tag C30, the slide and rotation mechanism control unit 330 slides the slide and rotation mechanism part D60 to transfer the bottle B to the connection position with the treatment solution pipe D45 and so on.

Next, the connection control unit 350 rotates the rotation part D22 to move the raising and lowering part D21 downward as illustrated in FIG. 18(*a*) and FIG. 18(*b*) to connect the treatment solution pipe D45 and the gas pipe D55 to the treatment solution connecting part C45 and the gas connecting part C55 of the cap C, respectively (Step S108). After the connection, ventilation of bubbles in the bottle B and so on are performed and then the treatment solution in the bottle B is supplied to the BCT block 5 or the like via the treatment solution pipe D45.

Next, in the cap change apparatus 20, the procedure of changing the cap for transfer time attached to the bottle B storing the treatment solution with the cap C with straw attached to the empty bottle B will be described using FIG. 19(*a*) to FIG. 19(*f*). Note that, in FIG. 19(*a*) to FIG. 19(*f*), the empty bottle B is indicated by an empty bottle BX and the cap for transfer time is indicated by a cap CX for transfer time for easy explanation.

Here, as illustrated in FIG. 19(*a*), the change work of the cap is started from the state that the empty bottle BX to which the cap C is attached and the bottle B to which the cap CX for transfer time is attached are transferred in the cap change apparatus 20. First, the cap change control unit 320 controls the second arm 22 to remove the cap CX for transfer time from the bottle B as illustrated in FIG. 19(*b*) and FIG. 19(*c*). Then, the cap change control unit 320 controls the first arm 21 to remove the cap C from the empty bottle BX as illustrated in FIG. 19(*c*) and FIG. 19(*d*) and clean the treatment solution straw part C40 of the cap C by the straw cleaning unit 23.

The cap change control unit 320 controls the first arm 21 to attach the cap C to the bottle B as illustrated in FIG. 19(*e*). The cap change control unit 320 then controls the second arm 22 to attach the cap CX for transfer time to the empty bottle BX. As described above, the cap change control unit 320 controls the first arm 21 and the second arm 22, whereby the cap C with straw is automatically changed with the cap CX for transfer time.

This embodiment is configured as described above, in which the bottle change apparatus 30 releases the connection between the treatment solution connecting part C45 of the bottle B connected to the treatment solution pipe D45 and the treatment solution pipe D45 while the cap C is kept attached to the opening portion of the bottle B, and connects the treatment solution pipe D45 with the treatment solution connecting part C45 of another bottle B. This makes it possible to change the bottle B without exposing the treatment solution straw part C40 to the outside, so that debris and so on never adhere to the treatment solution straw part C40. Accordingly, it is possible to inhibit debris and so on from entering the bottle B when changing the bottle B. Further, since the guide part D10 that positions the bottle B is provided, it is possible to surely connect the treatment solution connecting part C45 and the treatment solution pipe D45 together.

The connection mechanism part D20 of the chemical cart 31 moves the treatment solution pipe D45 along the vertical direction to thereby release the connection between the treatment solution connecting part C45 and the treatment solution pipe D45 or connect the treatment solution connecting part C45 and the treatment solution pipe D45 together. In this case, it is possible to easily connect the treatment solution connecting part C45 and the treatment solution pipe D45 together or release the connection therebetween only by moving the treatment solution pipe D45.

The control unit 300 changes the bottle B placed on the chemical cart 31 on the basis of the remaining amount of the treatment solution in the bottle B detected by the remaining amount detection sensor 400. Specifically, the connection control unit 350 controls the rotation of the rotation part D22 to raise and lower the raising and lowering part D21 when changing the bottle B. As described above, the connection control unit 350 controls raising and lowering of the raising and lowering part D21, whereby the connection of the bottle B or release of the connection can be automatically performed.

The bottle change apparatus 30 includes the crane 32 and the transfer apparatus 80 that transfer the bottle B into the chemical cart 31 and transfer the bottle B out of the chemical cart 31. Thus, the crane 32 and the transfer apparatus 80 transfer the bottle to facilitate the change of the bottle.

As the crane 32 and the transfer apparatus 80, a crane, a robot arm, or a conveyor can be used. In this case, the transfer of the bottle can be easily performed using the crane, the robot arm, or the conveyor.

The crane 32 and the transfer apparatus 80 are controlled by the transfer control unit 310. The transfer control unit 310 controls the crane 32 and the transfer apparatus 80, whereby the transfer of the bottle B can be automatically performed.

The coating and developing apparatus 1 includes the treatment solution supply block S4 having the bottle change apparatus 30. Thus, the bottle B storing the treatment solution to be used in the BCT block 5 or the like can be changed by the bottle change apparatus 30.

Further, in the cap C, the treatment solution pipe D45 is brought close to the treatment solution connecting part C45 along the extending direction of the treatment solution flow passage R1 at the end portion outside the bottle B of the treatment solution straw part C40. Then, the treatment solution pipe D45 is pressed against the treatment solution connecting part C45, and the treatment solution pipe D45 is connected to the treatment solution connecting part C45. As described above, by pressing the treatment solution pipe D45 against the treatment solution connecting part C45, the treatment solution connecting part C45 is connected to the treatment solution pipe D45, so that the treatment solution connecting part C45 and the treatment solution pipe D45 can be surely connected together.

The treatment solution flow passage R1 at the end portion outside the bottle B of the treatment solution straw part C40 is extended along the vertical direction. In this case, the treatment solution pipe D45 located above the cap C and the treatment solution connecting part C45 can be connected together.

By inserting the treatment solution pipe D45 into the treatment solution connecting part C45, the treatment solution connecting part C45 and the treatment solution pipe D45 can be more surely connected together.

The cap C includes the cover C20 that covers the treatment solution connecting part C45 to be exposable. In this case, the treatment solution connecting part C45 can be covered by the cover C20 when the treatment solution pipe D45 is not connected to the treatment solution connecting part C45. Accordingly, it is possible to inhibit debris and so on from entering the bottle B from the treatment solution connecting part C45.

Further, in the cap C, the gas pipe D55 is brought close to the gas connecting part C55 along the extending direction of the gas flow passage R2 at the end portion outside the bottle B of the gas flow passage forming part C50. Then, the gas pipe D55 is pressed against the gas connecting part C55, and the gas pipe D55 is connected to the gas connecting part C55. As described above, by pressing the gas pipe D55 against the gas connecting part C55, the gas connecting part C55 is connected to the gas pipe D55, so that the gas connecting part C55 provided at the cap C and the gas pipe D55 can be surely connected together.

The cap change apparatus 20 includes the first arm 21 and the second arm 22 attach/detach the above-described cap C to/from the bottle B. Thus, the first arm 21 and the second arm 22 of the cap change apparatus 20 can change the cap C, facilitating the change work of the cap C. Note that the first arm 21 that attaches/detaches the cap C is a first cap change mechanism, and the second arm 22 that attaches/detaches the cap CX for transfer time is a second cap change mechanism in this application.

The one embodiment of the present invention has been described above, but the present invention is not limited to the above embodiment. For example, though the rotation part D22 is rotated to raise and lower the raising and lowering part D21 as illustrated in FIG. 9(*a*) and FIG. 9(*b*) in the above embodiment, a connection mechanism part D20A may be used in which a drive part D23 directly raises and lowers a raising and lowering part D24 to which the end portions of the treatment solution pipe D45 and the gas pipe D55 are connected as illustrated in FIG. 20(*a*) and FIG. 20(*b*). Note that the mechanism that raises and lowers the raising and lowering part D24 is not particularly limited, but various mechanisms can be used.

Further, as illustrated in FIG. 21(*a*) and FIG. 21(*b*), it is also possible to connect the treatment solution pipe D45 and the gas pipe D55 to the treatment solution connecting part C45 and the gas connecting part C55 respectively by raising and lowering the bottle B with respect to a pipe fixing part D25 to which the end portions of the treatment solution pipe D45 and the gas pipe D55 are fixed. In this case, a mechanism that raises and lowers the bottle B may be added to a slide and rotation mechanism part D60A. Note that the mechanism that raises and lowers the bottle B is not particularly limited, but various mechanisms can be used.

Though the treatment solution pipe D45 and gas pipe D55 side is raised and lowered in the embodiment described using FIG. 9(*a*) and so on and the bottle B side is raised and lowered in the modification example described using FIG. 21(*a*) and so on, it is also possible to perform the connection of the pipes by relatively moving both the treatment solution pipe D45 and gas pipe D55 side and the bottle B side.

The cap main body C10 of the cap C has a cylindrical shape as illustrated in FIG. 3(*b*) and so on in the embodiment, but the shape of the cap main body C10 is not limited to the cylindrical shape. For example, a cap main body C10A in a square pole shape like a cap C1 illustrated in FIG. 22(*a*) and FIG. 22(*b*) can also be used. In this case, inclined surfaces X can be provided at corners on the side on which the cap main body C10A is inserted into the guide part D10. Thus, the cap main body C10A can be easily fitted into the guide part D10.

Further, the cap C is provided with the cap guides C60 as illustrated in FIG. 3(*b*) and so on in the above embodiment, but may be configured not to be provided with the cap guides as illustrated in FIG. 22(*a*) and FIG. 22(*b*). In this case, the cap C1 can be positioned by bringing the side surfaces of the cap main body C10A into contact with the wall parts D11 of the guide part D10.

Though the opening portions of the treatment solution connecting part C45 and the gas connecting part C55 are provided in the upper surface of the cap C in the embodiment, the opening portions of the treatment solution connecting part C45 and the gas connecting part C55 may be provided in a side surface of a cap C2 as illustrated in FIG. 23(*a*) and FIG. 23(*b*). In this case, the treatment solution flow passage R1 at the end portion outside the bottle B of the treatment solution straw part C40 extends along the horizontal direction. Similarly, the gas flow passage R2 at the end portion outside the bottle B of the gas flow passage forming part C50 extends along the horizontal direction.

The cap C2 is moved along the horizontal direction and thereby fitted into the guide part D10. Accordingly, in the case of transferring in the horizontal direction the bottle B with the cap C attached thereto, the transfer operation of the bottle B also enables the connections between the treatment solution connecting part C45 and the gas connecting part C55, and, the treatment solution pipe D45 and the gas pipe D55, respectively. Providing the opening portions of the treatment solution connecting part C45 and the gas connecting part C55 in the side surface of the cap C2 makes it possible to inhibit debris and so on from entering the bottle B via the opening portions of the treatment solution connecting part C45 and the gas connecting part C55.

Further, in the case where the opening portions of the treatment solution connecting part C45 and the gas connecting part C55 are provided in the side surface of a cap C3 as illustrated in FIG. 24(*a*) and FIG. 24(*b*), the opening portion of the treatment solution connecting part C45 and the opening portion of the gas connecting part C55 can also be arranged side by side in the horizontal direction.

In the case where the opening portions of the treatment solution connecting part C45 and the gas connecting part C55 are provided in the side surface of a cap C4 as illustrated in FIG. 25(*a*) and FIG. 25(*b*), a cover C20A may be provided in a manner to cover the opening portions of the treatment solution connecting part C45 and the gas connecting part C55. In this case, the cover C20A is configured to include a cover main body C21A, a cover guide C22A, and a spring C23A.

The cover main body C21A has flexibility. The cover main body C21A slides in close contact with the upper surface and the side surfaces of the cap C4 when exposing or covering the treatment solution connecting part C45 and so on. The cover guide C22A is fixed to the end portion of the cover main body C21A. The cover guide C22A engages with the engagement part of the guide part D10 to slide the cover main body C21A to expose the opening portions of the treatment solution connecting part C45 and so on at the time when the cap C4 is fitted into the guide part D10. The spring C23A urges the cover main body C21A in a direction in which the opening portions of the treatment solution connecting part C45 and so on are covered.

Thus, even in the case where the opening portions of the treatment solution connecting part C45 and the gas connecting part C55 are provided in the side surface of the cap C4, when the cap C4 is fitted into the guide part D10, the cover guide C22A engages with the engagement part of the guide part D10 to slide the cover main body C21A. This exposes the opening portions of the treatment solution connecting part C45 and the gas connecting part C55, and enables the connections between the treatment solution connecting part C45 and the gas connecting part C55, and, the treatment solution pipe D45 and the gas pipe D55, respectively.

Further, when the cap C4 is removed from the guide part D10, the spring C23A urges the cover main body C21A to slide and cover the opening portions of the treatment solution connecting part C45 and the gas connecting part C55.

In place of the cover main body C21A having flexibility, a plate-shaped cover main body C21B may be used as illustrated in FIG. 26(*a*) and FIG. 26(*b*). In this case, when a cap C5 is fitted into the guide part D10, a cover guide C22B engages with the engagement part of the guide part D10 and moves in a direction of compressing a spring C23B. With the movement of the cover guide C22B, the cover main body C21B turns centering on the vicinity of the cover guide C22B into a state parallel with the upper surface of the cap C5. Then, with further movement of the cover guide C22B, the cover main body C21B is laid on the upper surface of the cap C5. As described above, even a cover C20B having the plate-shaped cover main body C21B can expose the opening portions of the treatment solution connecting part C45 and the gas connecting part C55 by turning the cover main body C21B.

Further, removing the cap C5 from the guide part D10 causes the spring C23B to urge the cover main body C21B laid on the upper surface of the cap C5 in a direction of pushing it out from the upper surface of the cap C5. Thus, the cover main body C21B turns in a manner to fall down centering on the vicinity of the cover guide C22B and covers the opening portions of the treatment solution connecting part C45 and the gas connecting part C55.

Further, a filter F that filtrates the treatment solution flowing through the treatment solution flow passage R1 may be provided at the middle of a treatment solution straw part C40A in the cap main body C10 as in a cap C6 illustrated in FIG. 27. In this case, it is possible to filtrate the treatment solution in the cap C. Further, the filter F is changed only by changing the cap C, thus offering good maintenability.

Further, in the case where the filter F is provided in the treatment solution flow passage R1, a branch pipe C80 may be connected to a position of the treatment solution straw part C40A closer to the bottle B than is the filter F, and a vent flow passage R3 formed by the branch pipe C80 may be connected to the treatment solution flow passage R1 formed by the treatment solution straw part C40A, as in a cap C7 illustrated in FIG. 28. In this case, ventilation of bubbles of the treatment solution flowing through the treatment solution flow passage R1 via the vent flow passage R3 can be performed before the treatment solution is supplied via the treatment solution flow passage R1.

Note that the bottle B is transferred from the bottle storage location to the treatment solution supply block S4 by the transfer apparatus 80 in the above embodiment, but may be manually conveyed. Further, the change of the bottle B in the bottle change apparatus 30 may also be manually performed.

A preferred embodiment of the present invention has been described above with reference to the accompanying drawings, but the present invention is not limited to the embodiment. It should be understood that various changes and modifications are readily apparent to those skilled in the art within the scope of the technical spirit as set forth in claims, and those should also be covered by the technical scope of the present invention.

What is claimed is:

1. A bottle change apparatus comprising a change mechanism that changes a bottle storing a treatment solution therein, the bottle comprising a bottle cap that seals an opening portion of the bottle, the bottle cap comprising:

a treatment solution straw part that forms a treatment solution flow passage for supplying the treatment solution in the bottle to an outside of the bottle and extends to an inside of the bottle; and a treatment solution connecting part that is provided at an end portion outside the bottle of the treatment solution straw part, said change mechanism comprising:

a connection mechanism part comprising a treatment solution pipe which is connected to the treatment solution connecting part of the bottle and through which the treatment solution supplied from the bottle flows; and a slide or rotation mechanism that transfers the bottle to a connection position where the treatment solution connecting part and the treatment solution pipe are connected together, wherein said connection mechanism part comprises:

an internal raising and lowering part that is supported to be movable in the vertical direction, that supports the treatment solution pipe, and that is raised and lowered along a vertical direction so that a connection between the treatment solution connecting part and the treatment solution pipe is released, or so that the treatment solution connecting part is connected to the treatment solution pipe; and a rotation part that houses the internal raising and lowering part, and that is supported to be rotatable, so that the rotation part remains stationary in the vertical direction when the rotation part rotates, wherein the rotation part has a groove extending along a direction inclining with respect to the vertical direction, wherein the internal raising and lowering part has a projection portion that is fitted into the groove.

2. The bottle change apparatus as set forth in claim 1, further comprising:

a remaining amount detection sensor that detects a fact that an amount of the treatment solution in the bottle connected to the treatment solution pipe has become a predetermined value or less; and an electronic connection controller that controls, when said remaining amount detection sensor detects the fact that the amount of the treatment solution in the bottle has become the predetermined value or less, said change mechanism to release connection between the treatment solution connecting part of the bottle connected to the treatment solution pipe and the treatment solution pipe and connect the treatment solution pipe and the treatment solution connecting part of another bottle together.

3. The bottle change apparatus as set forth in claim 1, further comprising:

a bottle transfer mechanism that transfers the bottle to said change mechanism and transfers the bottle from said change mechanism to a predetermined position.

4. The bottle change apparatus as set forth in claim 3, wherein said bottle transfer mechanism is a crane, a robot arm or a belt conveyor.

5. The bottle change apparatus as set forth in claim 3, further comprising:

an electronic transfer controller that controls, when said change mechanism changes the bottle connected to the treatment solution pipe, said bottle transfer mechanism to transfer the bottle whose connection with the treatment solution pipe has been released, form said change mechanism to the predetermined position, and transfer another bottle to said change mechanism.

6. The bottle change apparatus as set forth in claim 1, further comprising:

an internal raising and lowering guide groove in the connection mechanism part, the internal raising and lowering part is fitted into the internal raising and lowering guide groove, and the internal raising and lowering part raises and lowers along the internal raising and lowering guide groove.

7. A bottle change apparatus comprising a change mechanism that changes a bottle storing a treatment solution therein, the bottle comprising a bottle cap that seals an opening portion of the bottle, the bottle cap comprising:

a treatment solution straw part that forms a treatment solution flow passage for supplying the treatment solution in the bottle to an outside of the bottle and extends to an inside of the bottle; and a treatment solution connecting part that is provided at an end portion outside the bottle of the treatment solution straw part, said change mechanism comprising:

a connection mechanism part comprising a treatment solution pipe which is connected to the treatment solution connecting part of the bottle and through which the treatment solution supplied from the bottle flows;

a slide or rotation mechanism that mounts the bottle at a connection position where the treatment solution connecting part and the treatment solution pipe are connected together; and a guide with guide surface that receives the bottle cap, the guide positions the bottle so that the treatment solution connecting part of the bottle and the treatment solution pipe are connected together at said slide or rotation mechanism, wherein said connection mechanism part comprises:

an internal raising and lowering part that is supported to be movable in the vertical direction, that supports the treatment solution pipe, and that is raised and lowered along a vertical direction so that a connection between the treatment solution connecting part and the treatment solution pipe is released, or so that the treatment solution connecting part is connected to the treatment solution pipe; and a rotation part that houses the internal raising and lowering part, and that is supported to be rotatable so that the rotation part remains stationary in the vertical direction when the rotation part rotates, wherein the rotation part has a groove extending along a direction inclining with respect to the vertical direction, wherein the internal raising and lowering part has a projection portion that is fitted into the groove.

8. A substrate treatment apparatus comprising a bottle change apparatus that changes a bottle storing a treatment solution therein, and a substrate treatment unit that treats a substrate using the treatment solution supplied from a bottle which has been changed by said bottle change apparatus, the bottle comprising a bottle cap that seals an opening portion of the bottle, the bottle cap comprising:

a treatment solution straw part that forms a treatment solution flow passage for supplying the treatment solution in the bottle to an outside of the bottle and extends to an inside of the bottle; and a treatment solution connecting part that is provided at an end portion outside the bottle of the treatment solution straw part, said change mechanism comprising:

a connection mechanism part comprising a treatment solution pipe which is connected to the treatment solution connecting part of the bottle and through which the treatment solution supplied from the bottle flows; and a slide or rotation mechanism that transfers the bottle to a connection position where the treatment solution connecting part and the treatment solution pipe are connected together, wherein said connection mechanism part comprises:

an internal raising and lowering part that is supported to be movable in the vertical direction, that supports the treatment solution pipe, and that is raised and lowered along a vertical direction so that a connection between the treatment solution connecting part and the treatment solution pipe is released, or so that the treatment solution connecting part is connected to the treatment solution pipe; and a rotation part that houses the internal raising and lowering part, and that is supported to be rotatable so that the rotation part remains stationary in the vertical direction when the rotation part rotates, wherein the rotation part has a groove extending along a direction inclining with respect to the vertical direction, wherein the internal raising and lowering pat has a projection portion that is fitted into the groove.

* * * * *